US007309522B2

(12) United States Patent
Webb et al.

(10) Patent No.: US 7,309,522 B2
(45) Date of Patent: Dec. 18, 2007

(54) FIBERS MADE FROM BLOCK COPOLYMER

(75) Inventors: Steven P. Webb, Midland, MI (US); Jared A. Austin, Greer, SC (US); Thomas Baltes, Hannover (DE); Kenneth A. Toney, Baton Rouge, LA (US)

(73) Assignee: Advanced Design Concepts GmbH, Hannover (DE)

( * ) Notice: Subject to any disclaimer, the term of this patent is extended or adjusted under 35 U.S.C. 154(b) by 0 days.

(21) Appl. No.: 10/887,467

(22) Filed: Jul. 8, 2004

(65) Prior Publication Data

US 2005/0101739 A1 May 12, 2005

Related U.S. Application Data

(60) Provisional application No. 60/485,841, filed on Jul. 9, 2003.

(51) Int. Cl.
*D02G 3/02* (2006.01)

(52) U.S. Cl. ..... 428/292.1; 428/373; 525/271

(58) Field of Classification Search ..... 525/271; 428/292.1, 373

See application file for complete search history.

(56) References Cited

U.S. PATENT DOCUMENTS

| | | | | |
|---|---|---|---|---|
| 3,012,000 | A * | 12/1961 | Aries | 525/249 |
| 3,338,002 | A | 8/1967 | Kinney | 264/24 |
| 3,575,782 | A | 4/1971 | Hansen | 161/141 |
| 3,692,613 | A | 9/1972 | Pederson | 156/498 |
| 3,802,817 | A | 4/1974 | Matsuki et al. | 425/66 |
| 3,849,241 | A | 11/1974 | Butin et al. | 161/169 |
| 4,405,297 | A | 9/1983 | Appel et al. | 425/72 |
| 4,663,220 | A | 5/1987 | Wisneski et al. | 428/221 |
| 4,720,415 | A | 1/1988 | Vander Wielen et al. | 428/152 |
| 4,775,579 | A | 10/1988 | Hagy et al. | 428/284 |
| 4,789,699 | A | 12/1988 | Kieffer et al. | 524/27 |
| 4,812,112 | A | 3/1989 | Balk | 425/66 |
| 5,156,793 | A | 10/1992 | Buell et al. | 264/288.8 |
| 5,162,074 | A | 11/1992 | Hills | 156/644 |
| 5,226,992 | A | 7/1993 | Morman | 156/62.4 |
| 5,244,482 | A | 9/1993 | Hassenboehler, Jr. et al. | 55/528 |
| 5,266,648 | A | 11/1993 | Masse | 525/314 |
| 5,290,626 | A | 3/1994 | Nishio et al. | 428/224 |
| 5,332,613 | A | 7/1994 | Taylor et al. | 428/152 |
| 5,352,518 | A | 10/1994 | Muramoto et al. | 428/373 |
| 5,352,744 | A | 10/1994 | Bates et al. | 525/339 |
| 5,470,639 | A | 11/1995 | Gessner et al. | 428/152 |
| 5,594,080 | A | 1/1997 | Waymouth et al. | 526/126 |
| 5,665,300 | A | 9/1997 | Brignola et al. | 264/555 |
| 5,683,787 | A | 11/1997 | Boich et al. | 428/198 |
| 5,755,243 | A * | 5/1998 | Roberts et al. | 132/321 |
| 5,814,569 | A | 9/1998 | Suzuki et al. | 442/328 |
| 5,843,068 | A | 12/1998 | Allen et al. | 604/385.2 |
| 5,851,935 | A | 12/1998 | Srinivasan et al. | 442/328 |
| 5,861,074 | A | 1/1999 | Wu | 156/229 |
| 5,885,686 | A | 3/1999 | Cederblad et al. | 428/107 |
| 5,952,252 | A | 9/1999 | Shawver et al. | 442/407 |
| 5,997,989 | A | 12/1999 | Gessner et al. | 428/152 |
| 6,114,263 | A | 9/2000 | Benson et al. | 442/394 |
| 6,176,952 | B1 | 1/2001 | Maugans et al. | 156/73.1 |
| 6,184,290 | B1 * | 2/2001 | Ahmed et al. | 525/98 |
| 6,225,243 | B1 | 5/2001 | Austin | 442/361 |
| 6,255,236 | B1 | 7/2001 | Cree et al. | 442/328 |
| 6,280,676 | B1 | 8/2001 | Cederblad | 264/291 |
| 6,461,715 | B1 * | 10/2002 | Guenther et al. | 428/131 |
| 6,525,157 | B2 | 2/2003 | Cozewith et al. | 526/348 |
| 6,541,403 | B2 | 4/2003 | Billarant et al. | 442/364 |
| 6,967,178 | B2 * | 11/2005 | Zhou et al. | 442/149 |
| 2001/0038912 | A1 | 11/2001 | Billarant et al. | 428/364 |
| 2002/0147273 | A1 | 10/2002 | Patel et al. | 525/93 |

FOREIGN PATENT DOCUMENTS

| | | |
|---|---|---|
| WO | 99/17926 | 4/1999 |
| WO | 00/08243 | 2/2000 |
| WO | 00/20207 | 4/2000 |
| WO | 00/44556 | 8/2000 |
| WO | 03/027364 | 4/2003 |
| WO | 03/027366 | 4/2003 |
| WO | 03/027374 | 4/2003 |
| WO | 03/040201 | 5/2003 |
| WO | 03/082571 | 10/2003 |

OTHER PUBLICATIONS

PCT/US04/21742, Notification of Transmittal of the International Search Report and the Written Opinion of the International Searching Authority, or the Declaration, May 17, 2005.

* cited by examiner

*Primary Examiner*—Jeffrey Mullis
(74) *Attorney, Agent, or Firm*—O'Keefe, Egan, Peterman & Enders, LLP

(57) ABSTRACT

The present invention relates to compositions such as fibers, elastic yarns, wovens, nonwovens, knitted fabrics, fine nets, and articles produced at least in part from a styrenic block copolymer comprising at least two blocks produced from vinyl aromatic monomers and at least one block produced from alkyl-substituted, conjugated alkene monomers, where the block produced from the conjugated alkene may have sufficient substitution so as to prevent or significantly minimize thermal cross-linking of the residual unsaturation in the formed block during fiber formation. Additionally, the composition may be described as processable, without requiring any additives if, for example, the order-disorder-transition (ODT) temperature is less than about 280° C.

23 Claims, 11 Drawing Sheets

FIBERS MADE FROM BLOCK COPOLYMER

This application claims priority to provisional application Ser. No. 60/485,841, filed Jul. 9, 2003, incorporated herein by reference.

FIELD OF THE INVENTION

The present invention relates to compositions: fibers, elastic yarns, wovens, nonwovens, knitted fabrics, fine nets, and articles produced at least in part from a styrenic block copolymer (SBC) composition comprising at least two blocks produced from vinyl aromatic monomers and at least one block produced from conjugated alkene monomers, as well as processes for manufacture of such compositions and methods of use thereof.

BACKGROUND OF THE INVENTION

Materials with excellent stretchability and elasticity are needed to manufacture a variety of disposal and durable articles such as, for example, incontinence pads, disposable diapers, training pants, sports apparel, general apparel and furniture upholstery.

Disposable articles are typically elastic composite materials prepared from a combination of polymer film, fibers, sheets and absorbent materials as well as a combination of fabrication technologies. Whereas the fibers are prepared by well known extrusion/spinning processes such as spun bonding, melt blowing, melt spinning and continuous filament winding techniques, the film and sheet forming processes typically involve known bulk extrusion and coextrusion techniques, e.g., blown film, cast film, profile extrusion, injection molding, extrusion coating, and extrusion sheeting.

Block polymers, especially styrenic block copolymers (SBCs), generally are elastomeric materials that exhibit excellent solid-state elastic performance attributes. But the most common unsaturated block copolymers, styrene-butadiene-styrene triblock polymers (SBS), tend to exhibit mediocre thermal stability, especially in the molten state. In addition, SBS polymers readily form gels due to cross-linking at temperatures necessary to pass these materials through the fine holes of textile or nonwoven dies at commercial rates or draw-downs. Furthermore, drawing of SBS polymers as fibers at temperatures below their cross-linking temperature cannot be done at commercially viable levels due to ductile or melt fracture of the fiber.

Similarly, known partially hydrogenated (or partially saturated) styrene block copolymers (for example, KRATON G block copolymers formerly supplied by Shell Chemical Company, now sold by Kraton Corp.) and Septon (sold by Kuraray) are difficult to melt process and draw into fibers from their pure state. In fact, preparation of fine denier fiber (that is, less than or equal to 40 denier or 78 micron (1 micron=$10^{-6}$ m) diameter) or thin film (that is, less than or equal to 2 mils) from substantially-neat, partially hydrogenated or partially saturated block polymers is generally not possible at commercial fabrication rates. To overcome characteristic melt processing and drawing difficulties, partially hydrogenated block copolymers are commonly formulated with various additives such as oils, waxes and tackifiers. But in order to achieve good melt processability and drawability, very high levels of low molecular weight additives are typically required. Such high levels of low molecular weight additives tend to compromise strength and elastic properties. In addition, the hydrogenation process required to produce these polymers adds significant further cost.

There are as yet no commercial, low cost materials being produced, especially by the textile spinning, spunbond or meltblown techniques. The present inventors have recognized that it would be advantageous to have an inexpensive elastomeric material with good properties and a process that was economical and could be run at commercial rates.

SUMMARY OF THE INVENTION

We have discovered that certain copolymers comprising at least two blocks produced from vinyl aromatic monomers and at least one block produced from conjugated alkene monomers, surprisingly exhibit melt drawability and fiber processability, while providing retained or improved strength properties in fibers produced therefrom. The copolymers, which are not hydrogenated, may be referred to as styrenic block copolymers. That is, the styrenic block copolymers of this invention are the direct result of the polymerization of the styrenic monomer and the alkylene monomer without further treatment by hydrogenation after polymerization. Furthermore, these materials are less expensive than hydrogenated block polymers.

We have also discovered that these copolymers can be conveniently used to prepare improved disposable and durable elastic articles without requiring the use of extensive amounts of additives such as processing aids, oils, waxes, polyolefins and tackifiers. Thus, if desired, processing aids, oils, waxes, polyolefins, and/or tackifiers can be excluded in the practice of this invention.

The invention further relates to selection criteria to determine SBC materials suitable for the production of microfibers at commercial rates. The selection criteria are based on measurements made on compression molded plaques of small volume and analyzed via dynamical mechanical spectroscopy (ARES, described later). The use of selection criteria allows for the elimination of some materials which would not be expected to be spun via the claimed processes, without having to actually spin them, which may otherwise require considerable volumes of polymer and time. These criteria are:

1. an order/disorder transition (ODT) onset temperature of less than 280° C., where the ODT onset is determined by a usually sudden and significant increase in the loss tangent (also known as the tan delta) (G"/G') with temperature and found and easily discernable normally at temperatures above 125° C. (between 100° C. and 125° C. the $T_g$ of the styrenic blocks makes determination of the ODT difficult by this method). The determination of ODT onset temperature is a well known test. It may be equivalently determined by polarization-loss measurements (N. P. Balsara, D. Perahia, C. R. Safinya, M. Tirrell, and T. P. Lodge, *Macromolecules*, 25, 3896 (1992), incorporated herein by reference in its entirety); and 2. neither the shear modulus, G', nor the loss modulus, G", monotonically increase with temperature above the ODT up to 290° C.

Such materials, which pass both of the above tests, are expected to perform well in commercial, extrusion equipment, such as textile spinlines or spunbond or meltblown systems, operating at commercially viable throughputs (>0.1 g/hole/min) and high fiber draw rates (>300 m/min) with or without up to 50% non-SBC blend materials, assorted additives, process aids, fillers, or colorants.

While not wishing to be bound by theory, with respect to criterion 1, for a SBC material to be spinnable at commercial rates the melt must be amorphous or nearly so. To achieve this the material must be heated to temperatures above the ODT onset for some period of time. The period of time will be a function of the energy required by the material to transition from ordered to disordered, the temperature profile of the process and the shear, as can readily be determined through routine experimentation. It is advantageous to keep the material below any significant degradation that will either cross-link the material or cause it to lose sufficient molecular weight to reduce significantly its elasticity.

With respect to criterion 2, a monotonic rise in G' and/or G" with temperature indicates that cross-linking or gellation is occurring. At temperatures where the material has a low modulus, ~1000 dyne/cm$^2$, G' and G" tend to get noisy or even register negative (unrealistic) values; however, a monotonic rise in modulus values with temperature can be seen, if present, even under these conditions. If this happens near the processing temperature, especially within +/−30° C. of the processing temperature, then the material will not be spinnable through fine capillaries at commercial rates. This is usually the case with SBS, but not SIS, above 230° C. and thus, while most SIS materials can be used in the practice of this invention, most SBS materials will not be useable.

One aspect of the present invention is a fiber produced from a composition comprising a copolymer that comprises at least two blocks produced from vinyl aromatic monomers and at least one block produced from conjugated alkene monomers. The copolymer includes a conjugated alkene block such that thermal cross-linking does not take place significantly at the processing temperature, usually between 200° and 280° C. It should be appreciated that by saying "no thermal cross-linking takes place"; it is meant that no appreciable cross-linking occurs that deleteriously affects processing. While not wishing to be bound by theory, it is believed that cross-linking is reduced in the soft block by limiting the amount of vinyl content (1,2 and/or 3,4 bonding in isoprene polymerization, for example) and/or by arrangements of the cis/trans unsaturation and/or by including steric groups to hinder the cross-linking reaction.

The compositions that may be produced in accordance with this invention may also be produced from any mixture of SBCs, including diblocks, hydrogenated low $M_n$ tackifiers, higher blocks, asymmetric blocks, tapered blocks and star blocks, as long as the mixture complies with the selection criteria.

In another embodiment of the invention, the fiber may be produced from a composition comprising the copolymer and additionally comprising at least one other material, at less than about 50% of the total weight of the resulting composition, such as a polyethylene or other polyolefin polymer or wax; a fluoropolymer or other fiber processing aid; a mineral oil; or polysiloxane.

Furthermore, additives may be employed in the practice of this invention such as antioxidants, radical scavengers, amines, U.V. inhibitors, colorants, fillers, antiblock agents, slip agents, luster modifiers, and the like, and combinations thereof. Typically, if present, each additive is used in an amount less than about 5 percent by weight.

Surprisingly, it has been discovered that block copolymers having non-hydrogenated soft blocks (blocks originating from the conjugated alkene monomers) with sterically hindered chains, even though unsaturated, can be successfully melt drawn, including meltspun into fine denier fibers, where the comparative block polymer without sterically hindered chains (for example, butadiene blocks in SBS triblock copolymers) cannot be melt drawn nor melt spun into fibers. In one embodiment the fiber has a diameter of less than about 450 microns. In other embodiments, the fiber may have a diameter less than about 400 microns, less than about 200 microns, or less than 100 microns. This discovery is believed to be attributable to the surprising low shear melt viscosities of these block copolymers at processing temperatures (usually more than 30° C. above their ODTs). While not wishing to be bound by theory, the benefit of SIS-like polymers is also believed to be derived from their propensity to degrade by chain scission rather than cross-linking at high temperature. Chain scission is less of a detriment than cross-linking and at low levels may be an advantage to spinning. The higher temperature processing capability is most critical as it allows the polymer to be melted to an amorphous (disordered) state above the ODT onset. Materials which have residual order tend to form fibers that fail (break) ductilely when drawn at high velocities (>300 m/min). Comparatively, polymeric block materials, such as SBS, with similar molecular weights, exhibit significant cross-linking which fouls fiber spinning at the necessary processing temperatures or, if processed at temperatures below the onset of cross-linking, result in a melt with poor drawability and cannot be spun as fine fibers. In addition, it is well known that common hydrogenated species of this type (hydrogenated SBS produces a block copolymer known as SEBS), even though they do not suffer cross-linking, cannot readily be drawn as fibers without extensive use of additives.

Ultimate fiber properties are a function of styrene content, $M_w$, ODT, and block architecture. However, all the compositions within the specifications of this invention and composed of blocks within the specifications of this invention can be spinnable at commercial rates to commercial denier fibers.

The selection criteria for spinnability, as set forth in this patent, is aimed at the most rigorous process (spunbond) requiring the highest material performance, especially at high SBC elastomer content (>80% of the total weight of the fiber). It is possible that other microfiber spinning processes or microfibers with less SBC elastomer maybe spun from SBCs outside of this selection criteria.

Advantageously, it has been found that webs made of conjugate filaments (e.g., bicomponent fibers) can be made using the copolymers of this invention which, unexpectedly, can be thermal point bonded at a temperature substantially lower than the normal bonding point of the second (not the block copolymer) component. In general, this temperature is at least 20° C. below the normal bonding temperature. In one embodiment, the temperature is at least 40° C. below the normal bonding temperature. An example of such a conjugate fiber is a bicomponent fiber made from SIS or SISIS and a polyolefin such as polyethylene, polypropylene, or combination thereof, in which the polyolefin occupies at least a portion of the surface of a fiber. It has been surprisingly found that overlaid webs (whether the webs are from separate or from the same roll) of such a bicomponent fiber can be bonded to hold against unwrapping, using merely pressure from a person's fingernail.

In view of the foregoing, it should be appreciated that in one broad respect, this invention is a fiber produced from a composition comprising 50 to 100 weight % of one or more block copolymer, wherein at least one of the non-hydrogenated block copolymers has at least two blocks produced from vinyl aromatic monomers and at least one block produced from alkyl-substituted (e.g., the alkyl being from one to ten carbons) conjugated alkene monomers, wherein the composition has an order/disorder transition (ODT) onset of less than 280° C., and neither the shear modulus, G', nor loss modulus, G", monotonically increase with temperature in the range from the ODT, or 150° C. in the absence of an ODT, to 280° C. In this respect, the fiber can have a composition that comprises up to 50% of a processing additive; the processing additive can be a fluorocarbon, a polyolefin, a mineral oil, a polysiloxane fluid, a tackifier, a wax, or combination thereof; the composition may include up to 5% of an additive to mitigate degradation of the fiber's properties, an additive to add color, luster, deluster, or filling, anti-block additive, a slip agent, or combination thereof; the block copolymer can be a triblock having two vinyl aromatic monomer unit blocks and one alkyl-substituted, conjugated alkene monomer unit block; the block copolymer can be a pentablock having three vinyl aromatic monomer unit blocks and two alkyl-substituted, conjugated alkene monomer unit blocks; the conjugated alkene monomer can be isoprene; the conjugated alkene monomer can be of formula $R_2C{=}CR{-}CR{=}CR_2$, wherein the monomer has at least five carbons, and wherein each R, independently in each occurrence, is hydrogen or alkyl of from one to four carbons or any two R may form a ring; at least one of the vinyl aromatic monomers can be styrene; the fiber can have a diameter less than 400 microns; the fiber can be in the form of a conjugate fiber; the fiber can be in the form of a conjugate fiber which has a sheath/core or tipped multilobal (e.g., trilobal) cross section; the fiber can be in the form of a conjugate fiber, which has a sheath core or tipped multilobal (e.g., trilobal) cross section, wherein the sheath or the tip component is a polyolefin; the core comprises a styrene-isoprene-styrene triblock or higher copolymer; the core comprises a styrene-isoprene-styrene-isoprene-styrene pentablock or higher copolymer; or any combination thereof. The fiber can be used to form a woven or knitted fabric, yarn, filament, strand, or fine net. The fiber can be used to form a nonwoven, including a nonwoven wherein the nonwoven is spunlaid, or is meltblown, or any combinations thereof, wherein the fiber is a conjugate fiber, said conjugate fiber comprising the block copolymer and at least one polyolefin component, wherein said polyolefin component at least partially envelops the block copolymer, wherein the fibers are normally bonded at a temperature substantially below the bonding temperature of the polyolefin component, wherein the polyolefin is polyethylene and the normal bonding temperature is about 120-130° C., wherein the polyolefin is polypropylene and the normal bonding temperature is about 140° C., wherein the fiber is formed by extruding at a temperature above the ODT, wherein the fiber is extruded at a temperature at least 10° C. above the ODT, wherein the fiber is extruded at a temperature at least 50° C. above the ODT; or any combination thereof. The fiber can be drawn at a velocity of 300 m/min or greater. The fiber or nonwoven can be used to form a laminate wherein at least one layer comprises the fibers or fabrics disclosed herein. The fibers can be used to form an article, including an article such as a disposable diaper, an elastic tab, a waist band, a leg cuff, a standing leg cuff, a side panel, an incontinent garment, a medical garment, a bandage or a textile apparel. The fiber or nonwoven can be produced by melt blowing, by a spunbond process, or by a combination thereof. The fiber can be made from other than the block copolymer. In the fiber, the block copolymer can be a styrene-isoprene block copolymer having a number average molecular weight styrene content per block of the block copolymer in the range from about 6,000 to about 45,000 grams/mole and/or having a number average molecular weight isoprene content per block of the block copolymer in the range from about 20,000 to about 150,000 grams/mole, with the total weight of styrene used-to make the block copolymer being 50% or less by weight.

In another broad respect, this invention is a fiber produced from a composition comprising 50% to 100% by weight of one or more block copolymers, wherein at least one block copolymer has at least two blocks produced from a vinyl aromatic monomer having up to 20 carbons and from a conjugated alkene monomer of formula:

$$R_2C{=}CR{-}CR{=}CR_2$$

wherein each R, independently in each occurrence, is hydrogen, or alkyl of one to four carbons, or any two R join to form a ring, wherein the conjugated alkene monomer has at least five carbons and no more than 20 carbons. Preferably at least one R is alkyl, such as of from one to ten carbons. In this process, the composition may comprise up to 50% of a processing additive; the processing additive can be a fluorocarbon, a polyolefin, a mineral oil, a polysiloxane fluid, a tackifier, a wax, or combination thereof; the composition can include up to 5% of an additive to mitigate degradation of the fiber's properties; an additive to add color, luster, deluster, or filling; anti-block additive; a slip agent; or combination thereof; the block copolymer can be a triblock having two vinyl aromatic monomer unit blocks and one alkyl-substituted, conjugated alkene monomer unit block; the block copolymer can be a pentablock having two vinyl aromatic monomer unit blocks and two alkyl-substituted, conjugated alkene monomer unit blocks; the conjugated alkene monomer can be isoprene; at least one of the vinyl aromatic monomers can be styrene; the fiber can have a diameter less than 400 microns; the fiber can be in the form of a conjugate fiber; the can be in the form of a conjugate fiber which has a sheath core or tipped multilobal (e.g., trilobal) cross section; the fiber can be in the form of a conjugate fiber, which has a sheath core or tipped multilobal (e.g., trilobal) cross section, wherein the sheath or the tip component is a polyolefin; the core can comprise an styrene-isoprene triblock or higher copolymer; the core can comprise an styrene-isoprene pentablock or higher copolymer; or any combination thereof.

In another broad respect, this invention is an article of manufacture comprising a multifilament yarn, woven fabric or nonwoven web comprising at least one fiber made from a composition comprising 50% to 100% by weight of one or more block copolymers, wherein each block copolymer has at least two blocks produced from a vinyl aromatic monomer having up to 20 carbons and from a conjugated alkene monomer of formula:

$$R_2C{=}CR{-}CR{=}CR_2$$

wherein each R, independently in each occurrence, is hydrogen or alkyl of one to four carbons or any two R form a ring, wherein the conjugated alkene monomer has at least five carbons and no more than 20 carbons. In this respect, the composition may comprise up to 50% of a processing additive; the processing additive can be a fluorocarbon, a polyolefin, a mineral oil, a polysiloxane fluid, a tackifier, a wax, or combination thereof; the composition can include up to 5% of an additive to mitigate degradation of the fiber's properties; an additive to add color, luster, deluster, or filling; anti-block additive; a slip agent; or combination thereof; the block copolymer can be a triblock having two vinyl aromatic monomer unit blocks and one conjugated alkene monomer unit block; the block copolymer can be a pentablock having three vinyl aromatic monomer unit blocks and two conjugated alkene monomer unit blocks; the conjugated alkene monomer can be isoprene; at least one of the vinyl aromatic monomers can be styrene; the fibers can have a diameter less than 400 microns; the fiber can be in the form of a conjugate fiber; the fiber can be in form of a conjugate fiber which has a sheath core or tipped multilobal (e.g., trilobal) cross section; the fiber can be in the form of a conjugate fiber, which has a sheath core or tipped multilobal (e.g., trilobal) cross section, wherein the sheath or the tip component is a polyolefin; the core can comprise an SI triblock or pentablock or higher copolymer.

In another broad respect, this invention is a process for the production of a nonwoven web, comprising:

extruding a composition comprising 50% to 100% by weight of at least one block copolymer through a spinneret to form fibers such as filaments;

cooling the fibers such as filaments;

drawing the fibers such as filaments; and forming a nonwoven web of the fibers such as filaments;

wherein the block copolymer has at least two blocks produced from a vinyl aromatic monomer and at least one block formed from a conjugated alkene monomer, and wherein the composition has an order/disorder transition (ODT) onset temperature of less than 280° C. and has a shear modulus, G', and loss modulus, G", neither of which monotonically increase with temperature in the range from the ODT, or 150° C. in the absence of an ODT, to 280° C. In this process, the composition can comprise up to 50% of a processing additive; the processing additive can be a fluorocarbon, a polyolefin, a mineral oil, a polysiloxane fluid, a tackifier, a wax, or combination thereof; the composition can include up to 5% of an additive to mitigate degradation of the fiber's properties, an additive to add color, luster, deluster, or filling, anti-block additive, a slip agent, or combination thereof; the block copolymer can be a triblock having two vinyl aromatic monomer unit blocks and one alkyl-substituted, conjugated alkene monomer unit block; the block copolymer can be a pentablock having three vinyl aromatic monomer unit blocks and two alkyl-substituted, conjugated alkene monomer unit blocks; the conjugated alkene monomer can be isoprene; the conjugated alkene monomer can be of formula $R_2C{=}CR{-}CR{=}CR_2$, wherein the monomer has at least five carbons, and wherein each R, independently in each occurrence, is hydrogen or alkyl of from one to four carbons or any two R may form a ring; at least one of the vinyl aromatic monomers can be styrene; the fibers can have a diameter less than 400 microns; the fibers can be in the form of a conjugate fiber; the fibers can be in the form of a conjugate fiber which has a sheath core or tipped multilobal (e.g., trilobal) cross section; the fibers can be in the form of a conjugate fiber, which has a sheath core or tipped multilobal (e.g., trilobal) cross section, wherein the sheath or the tip component is a polyolefin; the fibers comprise a core where the core comprises an styrene-isoprene-styrene triblock copolymer or a pentablock copolymer; the fiber can be a conjugate fiber, said conjugate fiber comprising the block copolymer and at least one polyolefin component, wherein said polyolefin component at least partially envelops the block copolymer; the fibers can be thermal point bonded at a temperature substantially below the normal bonding temperature of the polyolefin component, the polyolefin can comprise polyethylene, polypropylene, or combination thereof; the extruding can be at a temperature at least 10° C. above the ODT; the extruding can be at a temperature at least 50° C. above the ODT; the heated fiber can be drawn at a velocity of 300 m/min or greater; the block copolymer can be a styrene-isoprene block copolymer having a number average molecular weight styrene content per block of the block copolymer in the range from about 6,000 to about 45,000 grams/mole and/or having a number average molecular weight isoprene content per block of the block copolymer in the range from about 20,000 to about 150,000 grams/mole, with the total weight of styrene used to make the block copolymer being 50% or less by weight.

In another broad respect, this invention is a process for the production of a nonwoven web, comprising:

extruding a composition comprising 50% to 100% by weight of at least one block copolymer through a spinneret to form fibers (e.g., filaments);

cooling the fibers;

drawing the fibers; and forming a nonwovens web of the fibers;

wherein at least one block copolymer has at least two blocks produced from a vinyl aromatic monomer having up to 20 carbons and from a conjugated alkene monomer of formula:

$$R_2C{=}CR{-}CR{=}CR_2$$

wherein each R, independently in each occurrence, is hydrogen, or alkyl of one to four carbons, or any two R join to form a ring, wherein the conjugated alkene monomer has at least five carbons and no more than 20 carbons. In this process, the composition can comprise up to 50% of a processing additive; the processing additive can be a fluorocarbon, a polyolefin, a mineral oil, a polysiloxane fluid, a tackifier, a wax, or combination thereof; the composition can include up to 5% of an additive to mitigate degradation of the fiber's properties, an additive to add color, luster, deluster, or filling, anti-block additive, a slip agent, or combination thereof; the block copolymer can be a triblock having two vinyl aromatic monomer unit blocks and one alkyl-substituted, conjugated alkene monomer unit block; the block copolymer can be a pentablock having three vinyl aromatic monomer unit blocks and two alkyl-substituted, conjugated alkene monomer unit blocks; the conjugated alkene monomer can be isoprene; at least one of the vinyl aromatic monomers can be styrene; the fibers can have a diameter less than 400 microns; the fibers can be in the form of a conjugate fiber; the fibers can be in the form of a conjugate fiber which has a sheath core or tipped multilobal (e.g., trilobal) cross section; the fibers can be in the form of a conjugate fiber, which has a sheath core or tipped multilobal (e.g., trilobal) cross section, wherein the sheath or the tip component is a polyolefin; the fibers can comprise a core where the core comprises an styrene-isoprene-styrene triblock or pentablock copolymer; the fiber can be a conjugate fiber, said conjugate fiber comprising the block copolymer and at least one polyolefin component, wherein said polyolefin component at least partially envelops the block copolymer; the fibers can be thermal point bonded at a temperature substantially below the normal bonding temperature of the polyolefin component; polyolefin may comprise polyethylene, polypropylene, or combination thereof; the extruding can be at a temperature at least 10° C. above the ODT; the fiber can be extruded at a temperature at least 50° C. above the ODT; the-heated fiber is drawn at a velocity of 300 m/min or greater; the block copolymer is a styrene-isoprene block copolymer having a number average molecular weight styrene content per block of the block copolymer in the range from about 6,000 to about 45,000 grams/mole and/or having a number average molecular weight isoprene content per block of the block copolymer in the range from about 20,000 to about 150,000 grams/mole, with the total weight of styrene used to make the block copolymer being 50% or less by weight; or any combination thereof.

It should be appreciated that as-used herein, a "fiber" forms the basic element of fabrics or other textile structures, and is generally characterized by having a length of at least 100 times its diameter or width. The term refers to units that can be spun into a yarn or made into a fabric by various methods including weaving, knitting, braiding, felting, and twisting. It is generally understood that fibers to be spun into yarn include a length of at least 5 millimeters, flexibility, cohesiveness, and sufficient strength. Other important properties include elasticity, fineness, uniformity, durability and luster. It should be appreciated that as used herein a "filament" refers to a fiber of an indefinite or extreme length such as found naturally in silk. Manufactured fibers can be extruded into filaments that are converted into filament yarn, staple, or tow. The term "fiber" is a more general term, which encompasses "filaments." Thus, a "filament" falls within the scope of the term "fiber."

DETAILED DESCRIPTION OF THE INVENTION

Figure 1A:
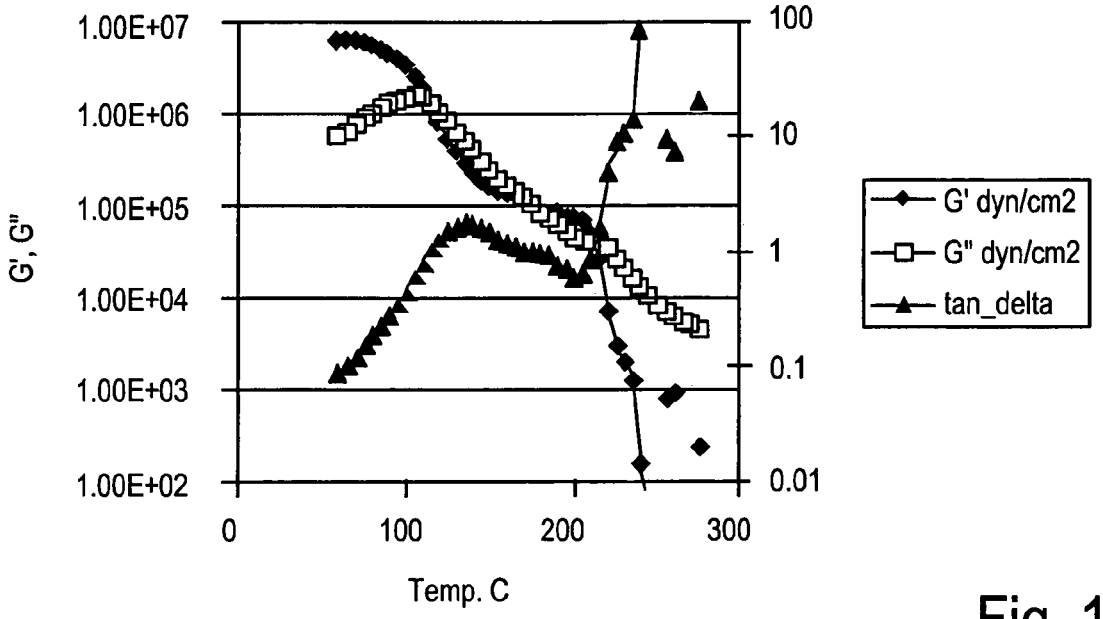
FIGS. 1A and 1B show ARES data for Exemplary and Comparative materials of the present invention. A monotonic increase in both G' and G" can be seen in FIG. 1B at a temperature of 240° C.

Block copolymers of the present invention comprise at least two distinct blocks of a polymerized vinyl aromatic monomer and at least one block of a polymerized conjugated alkene monomer. Typically this copolymer will be an A-B-A or A-B-A-B-A type block copolymer. Suitable block copolymers for use in the present invention may have one or more of the following characteristics:

a) a structure of the conjugated alkene monomer-derived block, such that thermal cross-linking does not take place significantly at the processing temperature this cross-linking or lack thereof being assessed via Dynamic Mechanical Spectroscopic analysis, wherein the shear modulus, G' or loss modulus, G", does not steadily increase with temperature (in the case of no or low cross-linking), up to a temperature of approximately 290° C.; and/or b) an order-disorder transition (ODT) onset temperature, if present, of less than 280° C.

The vinyl aromatic monomer is typically a monomer of the formula:

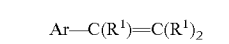

$$Ar—C(R^1)=C(R^1)_2$$

wherein $R^1$ is independently in each occurrence hydrogen or alkyl or forms a ring with another $R^1$, Ar is phenyl, halophenyl, alkylphenyl, alkylhalophenyl, naphthyl, pyridinyl, or anthracenyl, wherein any alkyl group contains 1 to 6 carbon atoms which may optionally be mono or multi-substituted with functional groups such as halo, nitro, amino, hydroxy, cyano, carbonyl and carboxyl. Typically the vinyl aromatic monomer has a carbon count less than 20 and a single vinyl group. In one embodiment, Ar is phenyl or alkyl phenyl, and typically is phenyl. Typical vinyl aromatic monomers include styrene (including conditions whereby syndiotactic polystyrene blocks are produced), alpha-methylstyrene, all isomers of vinyl toluene, especially para-vinyl toluene, all isomers of ethyl styrene, propyl styrene, butyl styrene, vinyl biphenyl, vinyl naphthalene, vinyl anthracene and mixtures thereof. The block copolymer can contain more than one specific polymerized vinyl aromatic monomer. In other words, the block copolymer can contain a pure polystyrene block and a pure poly-alpha-methylstyrene block or any block may be made up of mixed monomers.

The conjugated alkene monomer can be any monomer having 2 or more conjugated double bonds and preferably possesses at least one alkyl substitution. Such monomers include for example 2-methyl-1,3-butadiene (isoprene), 2-methyl-1,3 pentadiene, and similar compounds, and mixtures thereof. The block copolymer can contain more than one specific polymerized conjugated alkene monomer. In other words, the block copolymer can contain a polymethylpentadiene block and a polyisoprene block or mixed block(s). In general, block copolymers contain long stretches of two or more monomeric units linked together. Suitable block copolymers typically have a weight ratio of conjugated alkene monomer unit block to vinyl aromatic monomer unit block of from about 50:50 to about 95:5, in one embodiment from about 55:45 to about 90:10, based on the total weight of the conjugated alkene monomer unit and vinyl aromatic monomer unit blocks.

The block copolymers used in the present invention include triblock, pentablock, multiblock, tapered block, and star block ($(AB)_n$) polymers, designated $A(B'A')_xB_y$, where in each and every occurrence A is a vinyl aromatic block or mixed block, B is an unsaturated alkenyl block or mixed block, A', in each occurrence, may be the same as A or of different components or $M_w$, B', in each occurrence, may be the same as B or of different components or $M_w$, n is the number of arms on a star and ranges from 2 to 10, in one embodiment 3 to 8, and in another embodiment 4 to 6, x is $\geqq 1$ and y is 0 or 1. In one embodiment the block polymer is symmetrical such as, for example, a triblock with a vinyl aromatic polymer block of equal $M_w$, on each end.

The block copolymer can also be branched, wherein polymer chains are attached at any point along the polymer backbone. In addition, blends of any of the aforementioned block copolymers can also be used as well as blends of the block copolymers with a minor component of either hydrogenated block copolymers or certain butadiene based SBCs or both (as long as the selection criteria given above are met for these blends). In other words, a hydrogenated SBS block copolymer or SBS block polymer can be blended with an SIS block copolymer at a level of less than 50%, preferably less than 30%, based on the total weight of all block copolymers. It should be noted here that in some productions of triblock copolymers, small amounts of residual diblock copolymers may be produced.

All molecular weights, herein, are expressed in grams per mole, or Daltons. $M_w$, as used throughout this specification, can be determined using gel permeation chromatography (GPC), which was the technique used in determining molecular weights in the examples. The molecular weight of the non-hydrogenated block polymer and properties obtained are dependent upon the molecular weight of each of the monomer unit blocks. For non-hydrogenated block polymers, molecular weights are determined by comparison to narrow polydispersity homopolymer standards corresponding to the different monomer units segments (for example, polystyrene and polyisoprene standards are used for SIS block copolymers) with adjustments based on the composition of the block copolymer. Also for example, for a triblock copolymer composed of styrene (S) and isoprene (I), the copolymer molecular weight can be obtained by the following equation: $\ln(M_c)=x \ln(M_a)+(1-x) \ln(M_b)$, where $M_c$ is the molecular weight of the copolymer, x is the weight fraction of S in the copolymer, $M_a$ is the apparent molecular weight based on the calibration for Styrene homopolymer and $M_b$ is the apparent molecular weight based on the calibration for homopolymer 'b' (eg. polyisoprene). This method is described in detail by L. H. Tung, *Journal of Applied Polymer Science*, 24, 953 (1979). For simplicity, a single homopolymer standard (PS) was used here to reference the $M_w$ of the SBCs.

The block polymer composition (that is the ratio of conjugated diene monomer unit blocks to vinyl aromatic monomer unit blocks) can be determined using proton NMR and a comparative integration technique such as that described by Santee, Chang and Morton in *Journal of Polymer Science: Polymer Letter Edition*, 11, 449 (1973). By way of example, a Varian Inova NMR unit set at 300 MHz for $^1H$ may be used and samples of the block polymer may be analyzed as 4% solutions (w/v) in $CDCl_3$ (deuterochloroform).

Individual block lengths can be calculated from the weight average molecular weight, $M_w$, and $^1H$ NMR compositional analysis and by assuming a symmetrical structure (for example, a triblock with terminal polystyrene blocks).

The weight average molecular weight ($M_w$) of suitable non-hydrogenated block copolymers is generally greater than 30,000, in one embodiment greater than 40,000, more preferably from 50,000 to 250,000, typically to 200,000, preferably to 175,000, and more preferably to 150,000.

The block copolymers can have vinyl aromatic monomer unit blocks with individual weight average molecular weighted blocks, $M_w$, of from about 6,000, especially from about 8,000, to sum-total weighted aromatic blocks of about 15,000, to about 45,000. The sum-total, weight average molecular weight of the conjugated alkene monomer unit block(s) can be from about 20,000, especially from about 30,000, more especially from about 40,000 to about 150,000, and especially to about 130,000. The weight percent of all vinyl aromatic blocks to the total weight is 50% or less for at least one of the SBCs in a single SBC or a mixture of SBCs. The above ranges may characterize the copolymers when used essentially neat for fiber melt spinning purposes and for triblocks comprising two vinyl aromatic monomer unit blocks and one conjugated alkene monomer unit block and for pentablocks comprising three vinyl aromatic monomer unit blocks and two conjugated alkene monomer unit blocks.

Interestingly, the inventors have discovered that SBCs with more than three blocks (for example pentablocks) can be advantaged over triblocks in that, for a given $M_w$ and % styrene, the ODT of the higher numbered block copolymers are generally lower than for triblocks. Subsequently, their melt viscosity at a comparable temperature (>ODT of the pentablock) is lower. Therefore one may be able to go to higher $M_w$ and/or styrene content with, for example, a pentablock, than you can with the equivalent values in a triblock and still be within a preferred processing window of, for example, 200° to 280° C., while the triblock may need to be processed well above this temperature range. The ability to go to higher $M_w$ and/or styrene percent has the potential advantage of improving the fiber tensile properties.

It is important to note that each individual block of the block copolymer of the present invention, can have its own distinct molecular weight. In other words, for example, two vinyl aromatic polymer blocks may each have a different molecular weight.

Methods of making block polymers are well known. Block polymers are often made by anionic polymerization.

Compositions of the present invention can be made using one or more styrenic block copolymers with optional extender/processing aid blend components and additives. Blend species are typically non-SBC polymers, waxes, or oils and may be used in total quantities of up to 50% of the total weight of the composition. Additives include antioxidants, radical scavengers, amines, anti-blocking agents, absorbents, and the like and may be used in levels up to 10% and in one embodiment up to 5% each, based on the total weight of the composition. Regardless of what is mixed, blended or added into the final composition, it is important that the entire composition meet the properties as set forth herein in order to make fibers.

Mixtures or blends may be produced to reduce the ODT and/or processing temperature below 280° C. and, as long as cross-linking does not occur up to a temperature of 280° C., will fall within the scope of this invention. Blends include polymer, tackifiers, low molecular weight waxes, oils, and process aids, such as fluoropolymer spin aids. The mixture or blend or additives used in forming the composition can be prepared by any known technique including melt blending, dry blending (e.g. tumble blending) or solution mixing.

Polymeric materials for blending with the block copolymer include, but are not limited to, polyolefins, thermoplastic polyurethanes, polycarbonates, polyamides, polyethers, poly/vinyl chloride polymers, poly/vinylidene chloride polymers, and polyester polymers. Polymeric materials for blending with the block copolymer mixture may include other elastic polymers, such as, for example, but not limited to, polyurethanes, copolyester and copolyesteramide elastomers, an elastomeric or sulfonated ethylene/styrene interpolymer, an elastomeric ethylene-olefin interpolymer, an elastic polypropylene polymer, an enhanced polypropylene polymer, and a polyolefin elastomer or plastomer made using a single-site metallocene catalyst system (for example, a homogeneously branched ethylene polymer such as a substantially linear ethylene interpolymer or a homogeneously branched linear ethylene interpolymer). Blends with a minor component of polypropylene polymer are also possible, such as ternary blends that include a homogeneously branched ethylene polymer, for the preparation of fiber-containing fabrics that are processable at high stretching level as well as at high stretching rates. Generally the elastomeric polyolefins for blending include, for example, polyethylene(ethylene homopolymer), polystyrene, ethylene/alpha-olefin interpolymers, alpha-olefin homopolymers, such as polypropylene(propylene homopolymer), alpha-olefin interpolymers, such as interpolymers of polypropylene and an alpha-olefin having at least 4 carbon atoms. Representative polyolefins include, for example, but are not limited to, substantially linear ethylene polymers, homogeneously branched linear ethylene polymers, heterogeneously branched linear ethylene (including linear low density polyethylene (LLDPE), ultra or very low density polyethylene (ULDPE or VLDPE) medium density polyethylene (MDPE) and high density polyethylene (HDPE)), high pressure low density polyethylene (LDPE), ethylene/acrylic acid (EAA) copolymers, ethylene/methacrylic acid (EMAA) copolymers, ethylene/acrylic acid (EAA) ionomers, ethylene/methacrylic acid (EMAA) ionomers, ethylene/vinyl acetate (EVA) copolymers, ethylene/vinyl alcohol (EVOH) copolymers, polylactic acid (PLA), polyolefin carbon monoxide interpolymers polypropylene homopolymers and copolymers, ethylene/propylene polymers, ethylene/styrene interpolymers, graft-modified polymers (e.g., maleic anhydride grafted polyethylene such as LLDPE g-MAH), ethylene acrylate copolymers (e.g. ethylene/ethyl acrylate (EEA) copolymers, ethylene/methyl acrylate (EMA), and ethylene/methmethyl acrylate (EMMA) copolymers), polybutylene (PB), ethylene carbon monoxide interpolymer (e.g., ethylene/carbon monoxide (ECO), copolymer, ethylene/acrylic acid/carbon monoxide (EAACO) terpolymer, ethylene/methacrylic acid/carbon monoxide (EMAACO) terpolymer, ethylene/vinyl acetate/carbon monoxide (EVACO) terpolymer and styrene/carbon monoxide (SCO)), chlorinated polyethylene and mixtures thereof.

Additive classes that may be used in the practice of this invention include but are not limited to antioxidants, radical scavengers, and UV absorbers, e.g., Irgafos®, Irgastab, Tinuvin, or Irganox® supplied by Ciba Geigy Corp. The antioxidants, radical scavengers, and UV absorbers may be added to the mixture and/or blends thereof at levels typically less than 1% to protect against undo degradation during shaping or fabrication operation or to better control the extent of grafting or crosslinking (i.e., inhibit excessive gelation) or to stabilize the final product. In-process additives, e.g. calcium stearate, water, and fluoropolymers may also be used for purposes such as for the deactivation of residual catalyst or for further improved processability. Colorants, color enhancers, and fillers, such as masterbatches of dyes in thermoplastic polymers, titanium dioxide, talc, clay, silica, calcium carbonate, magnesium hydroxide, stearic acid and metal stearates (these are anti-block waxes), and the like are also possible.

Representative tackifiers include aliphatic $C_5$ resins, polyterpene resins, hydrogenated resins, mixed aliphatic-aromatic resins, rosin esters, and hydrogenated rosin esters. The tackifier employed will-typically have a viscosity at 350° F., as measured using a Brookfield viscometer, of no more than 300, generally no more than 150, and in one embodiment, of no more than 50 centipoise. The tackifier employed will typically have a glass transition temperature greater than 50° C.

Representative aliphatic tackifiers for use in the present invention include those available under the trade designations Escorez®, Piccotac®, Mercures®, Wingtack®, Hi-Rez®, Quintone®, and Tackirol®. Suitable polyterpene tackifiers include those available under the trade designations Nirez®, Piccolyte®, Wingtack®, and Zonarez®. Suitable hydrogenated tackifiers include those available under the trade designations Escorez®, Arkon®, and Clearon®. Representative mixed aliphatic-aromatic tackifiers include those available under the trade designations Escorez®, Regalite®, Regalrez®, Hercures®, AR®, Imprez®, Norsolene® M, Marukarez®, Arkon® M, Quintone®, etc. Other tackifiers may be employed, provided they are compatible with the block copolymer.

Waxes may be used as processing aids, such as paraffinic or crystalline polymers having a number average molecular weight less than 6000. Exemplary polymers falling within this category include ethylene homopolymers available from Petrolite, Inc. (Tulsa, Okla.) as Polywax® 500, Polywax® 1500 and Polywax® 2000; and paraffinic waxes available from CP Hall under the product designations 1230, 1236, 1240, 1245, 1246, 1255, 1260, and 1262. Waxes for use in the present invention have a number average molecular weight less than 5000 and greater than 800, in one embodiment greater than 1300. In general, the wax has a melting point above 25° C. and below 150° C. Representative ethylene polymer waxes, i.e., an ethylene homopolymer (either a traditional ethylene homopolymer wax or an ethylene homopolymer prepared with a constrained geometry catalyst) or an interpolymer of ethylene and a comonomer, having a density of at least 0.910 g/cm$^3$ and no more than 0.970 g/cm$^3$ can be used in the practice of this invention.

Oils may be used in the practice of this invention including but not limited to fats, viscous liquids, greases and volatile liquids which are classified as mineral, vegetable, animal, essential or edible oil. When employed, oils will be present in an amount less than 40%. Exemplary oils include white mineral oil (such as Kaydol® oil available from Witco), and Shellflex® 371 naphthenic oil (available from Shell Oil Company). Polysiloxane fluids also fall within this class, such as various polydimethylsiloxanes sold by Dow Corning.

The fibers and articles of the present invention have utility in a variety of applications. Suitable applications include, for example, but are not limited to, disposable personal hygiene products (e.g. training pants, diapers, absorbent underpants, incontinence products, feminine hygiene items and the like); disposable garments (e.g. industrial apparel, coveralls, head coverings, underpants, pants, shirts, gloves, socks and the like); infection control/clean room products (e.g. surgical gowns and drapes, face masks, head coverings, surgical caps and hood, shoe coverings, boot slippers, wound dressings, bandages, sterilization wraps, wipers, lab coats, coverall, pants, aprons, jackets), and durable and semi-durable applications such as bedding items and sheets, furniture dust covers, apparel interliners, car covers, and sports or general wear apparel.

Various homofil fibers can be made including textile fibers or yarns, staple fibers, spunbond fibers, melt blown fibers and gel spun fibers. Homofil fibers have a single polymer region or domain and does not have any other distinct polymer regions (as do, for example bicomponent fibers), even though the polymer itself may have a plurality of phases or microphases.

The fibers of the present invention, especially multicomponent fibers, can also be used as bonding fibers, including self-bonding fibers, especially where the fibers of the present invention have a lower softening point than the surrounding matrix fibers. In a bonding fiber application, the bonding fiber is typically blended with other matrix fibers and the entire structure is subjected to heat and/or pressure, where the bonding fiber melts and bonds the surrounding matrix fiber. In the self-bonding fiber case, the entire matrix is made of the bonding fiber. In the case of multicomponent fibers where at least one component is an elastomer of the present invention, and one component has less elasticity than this one component, the bonding temperature is less than the temperature required to bond a matrix of fibers of the less elastic component. Typical matrix fibers which benefit from use of the inventive elastic fibers disclosed herein include, but are not limited to, poly(ethylene terephthalate) fibers, cotton fibers, nylon fibers, polypropylene fibers, heterogeneously branched polyethylene fibers, homogeneously branched ethylene polymer fibers, linear polyethylene homopolymer fibers and the like and combinations thereof. The diameter of the matrix fiber can vary depending upon the end use application.

Bonding of higher temperature polymer fibers (such as the melt processable polymers mentioned above) can be achieved within the scope of the present invention by using the hereinabove block polymer, mixture, or blend as a component of a multicomponent fiber also containing the higher temperature polymer, especially at the core in a sheath/core or islands in an islands-in-the-sea bicomponent design, or by blending the block polymer or blend into the melt processable polymer. This technique is especially beneficial in the production of soft, high strength, low abrasion nonwovens webs based on polyethylene. In general, the normal bonding temperature for polyethylene is 120-130° C., in one embodiment about 120° C., and the normal bonding temperature for polypropylene is 140° C.

Conjugated fibers are also an aspect of the present invention. Conjugated fibers include fibers which have been formed from at least two polymers extruded from separate extruders but meltblown or spun together to form one fiber. Conjugated fibers are sometimes referred to as multicomponent or bicomponent fibers. The polymers are usually different from each other although conjugated fibers may be mono-component fibers. The polymers are sometimes arranged in substantially constant relative positions, i.e., distinct zones across the cross-section of the conjugated fibers, and extend continuously along the length of the conjugated fibers. The configuration of conjugated fibers can be, for example, a sheath/core (S/C) arrangement (wherein one polymer is surrounded by another), a side by side (S/S) arrangement, a segmented pie arrangement (S/P), a tri- or higher lobed structure with tips (T/T), or an "islands-in-the sea" (I/S) arrangement. The elastic fiber of the present invention can be in a conjugated configuration, for example, as a core or sheath, or both. Due to the adhesive nature of nearly all hot elastomers, however, in the case of spunlaid applications for nonwovens, it is advantageous to position the elastomeric block in the "core" position such that "core-to-core" contact is avoided, even though the elastomeric block polymer may be part of the fibers surface (for example in tipped trilobal designs). Similarly, it is generally disadvantageous to use S/S or S/P configurations for spunbonding, even though these structures are common for non-elastomers.

Any thermoplastic, fiber forming, less-elastic polymer would be possible as the second component, depending on the application. Cost, stiffness, melt strength, spin rate, stability, etc. will all be a consideration. The second component may be formed from any polymer or polymer composition exhibiting inferior elastic properties in comparison to the polymer or polymer composition used to form the first component. Exemplary non-elastomeric, fiber-forming thermoplastic polymers include polyolefins, e.g. polyethylene, polypropylene, and polybutene, polyester, polyamide, polystyrene, and blends thereof.

One specific example of a suitable second component polymer composition is a polyethylene/polypropylene blend. Typically, polyethylene and polypropylene are blended in proportions such that the material comprises between 2 and 98 percent by weight polypropylene, balance polyethylene. Strands made from these polymer blends have a soft hand with a very little "stickiness" or surface friction.

Various types of polyethylene may be employed in the second component with the most preferred being linear, low density polyethylenes discussed in connection with the first component. LLDPE can be produced such that various density and melt index properties are obtained which make the polymer well suited for melt-spinning with polypropylene. Linear low density polyethylene (LLDPE) also performs well in filament extrusion. Preferred density values range from 0.87 to 0.95 g/cc with 0.90 to 0.94 being more preferred, and preferred melt index values usually-range from 0.2 to about 150 g/10 min. (ASTM D1238-89, 190° C.)

The propylene included within the second component can be an isotactic or syndiotactic polypropylene homopolymer, copolymer, or terpolymer with the most preferred being in the form of a homopolymer. Modified, low-viscosity or high melt flow (MF) polypropylene (PP) may be employed. Exemplary melt flows include 35, 25, 17, and even 1 to 3. Examples of commercially available polypropylene polymers which can be used in the present invention include SOLTEX Type 3907 (35 MFR, CR grade), HIMONT Grade X10054-12-1 (65 MFR), Exxon Type 3445 (35 MFR), Exxon Type 3635 (35 MFR) and BP/AMOCO Type C BP 10-7956F (35 MFR), Aristech CP 350 JPP.

Exemplary polyesters suitable for use in the second component include copolymerized polyesters which are obtained by copolymerizing polyethylene terephthalate as the principal ingredient with up to 50 mole percent of another dicarboxylic acid component, such as isophthalic acid and/or up to 35 mole percent of another diol component, such as diethyelene glycol, triethylene glycol, neopentyl glycol, butanediol, and the like. The ratio (A mole %) of the isophthalic acid component and the ratio (B mole %) of copolymerization diol component are suitably selected by taking the melt spinning temperature, etc., into consideration. The ratio of isophthalic acid advantageously ranges from about 15 mole percent to 45 mole percent.

As was the case with the first component, where the second component is a blend, the polymer materials, e.g., polyethylene and polypropylene, are combined in appropriate proportional amounts and preferably intimately blended before producing the fibers.

The first (the elastic component of the present invention) and second components may be present within the multicomponent strands in any suitable amounts, depending on the specific shape of the fiber and end use properties desired. In advantageous embodiments, the first component forms the majority of the fiber, i.e., greater than about 50 percent by weight, based on the weight of the strand ("bos"). For example, the first component may beneficially be present in the multicomponent strand in an amount ranging from about 80 to 99 weight percent bos, such as in an amount ranging from about 85 to 95 weight percent bos. In such advantageous embodiments, the non-elastomeric component would be present in an amount less than about 50 weight percent bos, such as in an amount of between about 1 and about 20 weight percent bos. In beneficial aspects of such advantageous embodiments, the second component may be present in an amount ranging from about 3 to 15 weight percent bos, depending on the exact polymer(s) employed as the second component. In one advantageous embodiment, a sheath/core configuration having a core to sheath weight ratio of greater than or equal to about 85:15 is provided, such as a ratio of 95:5.

Alternatively, the first component may be present in amounts as low as about 30 weight percent or less, particularly in applications in which fiber stretch, tactics (touch) and economics are the primary concern, rather than elasticity (retractive force).

The shape of the fiber can vary widely. For example, typical fiber has a circular cross-sectional shape, but sometimes fibers have different shapes, such as a trilobal shape, or a flat (i.e., "ribbon" like) shape. Also the fibers, even though of circular cross-section, may assume a non-cylindrical, 3-dimentional shape, especially when stretched and released (self-bulking or self-crimping to form helical or spring-like fibers).

The novel elastic fiber of the present invention can be used with other fibers such as PET, Nylon, polyolefins and cotton to make elastic fabrics. One example is multifilament, multicomponent tows bundled to produce a yarn which is stretch-activated to permanently elongate the inelastic component. This process produces an elastic yarn with surprising softness, or hand, which is nothing like either of the individual components. This is surprisingly true even in the case of multicomponent fibers.

Fiber diameter can be measured and reported in a variety of fashions. Generally, fiber diameter is measured as a linear density in terms of denier per filament, or more simply as a width in microns. Denier is a textile term that is defined as the grams of the fiber per 9000 meters of that fiber's length. Monofilament generally refers to an extruded single strand having a denier per filament greater than 15, usually greater than 30. Fine denier fiber generally refers to fiber having a denier of about 15 or less. Microfiber generally refers to fiber having a diameter not greater than about 100 micrometers. For the present SBCs, assuming a typical solid density of 0.92 g/cm$^3$, a 100 micron diameter, pure monofilament fiber would have a denier of 65. In the case of blends or multicomponent fibers, the solid density must be measured or calculated to convert denier to micron diameter. For the inventive elastic fibers disclosed herein, the diameter can be widely varied. The fiber diameter can be adjusted to suit the capabilities of the finished article. Expected fiber diameter values would be: from about 5 to about 20 microns/filament for melt blown; from about 10 to about 50 micron/filament for spunbond; and from about 20 to about 200 micron/filament for continuous wound filament. Strands of any diameter are possible with the present materials, though are typically less than 450 microns. For apparel applications, the typical nominal denier is greater than 37, in other embodiments greater than or equal to 55 or greater than or equal to 65. These deniers may be made up from multiple filaments (tows) as well as monofilaments. Typically, durable apparel employ fibers or fiber tows with deniers greater than or equal to about 40. For disposable nonwoven applications, the diameter of the fiber can be below 75 microns, below 50 microns, or below 35 microns. Typically, in a nonwoven, the finer the fiber the better the distribution or coverage across the fabric for a given basis weight (weight of fibers per square area of fabric, for example in grams per square meter).

For elastic fibers it is typically the case that the same diameters are not achievable as with non-elastic materials. This is due to the nature of elastics as soft materials with very low $T_g$ components. Therefore during spinning, elastomers tend to "snap back" as soon as the draw tension is released, which results in an increase in the fiber diameter. Fine fibers (<40 microns in diameter) are readily achievable with good elasticity and small fibers (<15 microns) may be achieved with low elastic blends or multicomponent fibers with higher percentages of non-elastic components, for example by forming a bicomponent fiber with a high percentage of non-elastomer and then splitting the fiber to produce fibrils of elastomer and nonelastomer.

Basis weight refers to the areal density of a non-woven fabric, usually in terms of g/m$^2$ or oz/yd$^2$. Acceptable basis weight for a nonwoven fabric is determined by application in a product. Generally, one chooses the lowest basis weight (lowest cost) that meets the properties dictated by a given product. For elastomeric nonwovens one issue is retractive force at some elongation, or how much force the fabric can apply after relaxation at a certain extension. Another issue defining basis weight is coverage, where it is usually desirable to have a relatively opaque fabric, or if translucent, the apparent holes in the fabric should be of small size and homogeneous distribution. The most useful basis weights in the nonwovens industry for disposable products range from ½ to 3 oz/yd$^2$ (17 to 100 g/m$^2$, or gsm). Some applications, such as durable or semi-durable products, may be able to tolerate even higher basis weights. It should be understood that low basis weight materials may be adventitiously produced in a multiple beam construction. That is, it may be useful to produce an SMS (spunbond/meltblown/spunbond) composite fabric where each of the individual layers have basis weights even less than 17 gsm, but it is expected-that the preferred final basis weight will be at least 17 gsm. Similarly, laminates may be fashioned with nonwoven fabrics using the present inventive fibers where the basis weight of the inventive fabric may less than 17 gsm, yet imparts a good touch or flexibility not found in other nonwoven fabrics.

A nonwoven composition or article is typically a web or fabric having a structure of individual fibers or threads which are randomly interlaid, but not in an identifiable manner as is the case for a woven or knitted fabric. The elastic fiber of the present invention can be employed to prepare inventive nonwoven elastic fabrics as well as composite structures comprising the elastic nonwoven fabric in combination with non-elastic materials. The inventive nonwoven elastic fabrics may include bicomponent fibers made using the elastomeric block materials described herein and non-elastomeric polymers, such as polyolefins.

The fibers of this invention can be made using a melt blown technique by extruding a molten composition through a plurality of fine, usually circular, die capillaries as molten threads or filaments into converging high velocity, usually heated, gas streams (e.g. air) which function to attenuate the threads or filaments to reduced diameters. Thereafter, the filaments or threads are carried by the high velocity gas streams and deposited on a collecting surface to form a web of randomly dispersed fibers with average diameters generally smaller than 10 microns. In the case of conjugate elastomeric fibers with a large fraction of elastomeric polymer e.g., (>80%), including the elastomeric block polymers of this invention, it is generally difficult to produce fibers with an average diameter of less than 10 microns, but this does not reduce the utility of the produced sheet.

The fibers of this invention may be formed using the spunbond and spunlaid technique by

- extruding fibers such as in the form of filaments from a spinneret;
- cooling the filaments;
- attenuating the filaments by advancing them through the cooling zone with a draw tension that can be applied by either pneumatically entraining the filaments in an air stream or by wrapping them around mechanical draw rolls of the type commonly used in the textile fiber industry;
- collecting the drawn filaments into a web on a foraminous surface (spunlaid); and
- bonding the web of loose filaments into a fabric (spunbond).

The randomly dispersed fibers of the spunlaid or spunbond web will generally have an average diameter of between about 7 and about 30 microns in the case of usual materials such as polypropylene, polyamide and PET. In the case of elastomeric polymers, fiber diameters between 15 and 35 microns are more the norm. The cooling step may be achieved in the lab through cooling in air after the filament is extruded. In commercial operations, the cooling step is frequently achieved by blowing cool air over the filaments, and is sometimes referred to as quenching the filaments or fibers. In one embodiment, the air has a certain temperature below the elastic's hard segment Tg and any sheath's crystal melt temperature. However cooling is accomplished, the cooling generally serves to hasten the solidification of the molten filaments.

Examples of the various types of spunbonded processes are described in U.S. Pat. No. 3,338,992 to Kinney, U.S. Pat. No. 3,692,613 to Dorschner, U.S. Pat. No. 3,802,817 to Matsuki, U.S. Pat. No. 4,405,297 to Appel, U.S. Pat. No. 4,812,112 to Balk, and U.S. Pat. No. 5,665,300 to Brignola et al. A preferred spunbonded process for producing fabrics of this invention is described in U.S. Pat. No. 5,814,349.

Fabrics made from the inventive elastic fibers disclosed herein include knitted, woven and nonwoven fabrics. Nonwoven fabrics can be made variously, including by spunlacing (or hydrodynamically entangling) spunlaid webs), by carding or air or wet laying and thermally bonding staple fibers; by spunbonding continuous filaments in one continuous operation with some form of bonding prior to winding on a roll; or by melt blowing filaments to form a fabric and subsequently calendering or thermally bonding the resultant web. These various nonwoven fabric manufacturing techniques are well known and the fibers of this invention are not limited to any particular method. Other structures made from such fibers are also included within the scope of the invention, including e.g., blends of these novel fibers with other fibers (e.g., poly(ethylene terephthalate) (PET) or cotton).

Thermal bonding is typically conducted by heating fibers to affect the melting (or softening) and fusing of fibers such that a nonwoven fabric is produced. Thermal bonding includes point bonding, calendar bonding and through-air bonding as well as other known methods.

In addition to thermal bonding and hydroentangling, there are other known methods to stabilize fabrics, though in some cases bonding may not be needed as the fabric is autogenously (automatic-self) bonded, such as is often the case in meltblowing. These additional bonding techniques include ultrasonic bonding, chemical or adhesive bonding, needling, hydroentangling, and the like.

Fabricated articles which can be made using the inventive elastic fibers and fabrics disclosed herein include elastic composite articles (e.g., diapers) that have elastic portions. For example, elastic portions are typically constructed into diaper waist band portions to prevent the diaper from failing (as shown in U.S. Pat. No. 4,381,781 (Sciaraffa), the disclosure of which is incorporated herein by reference) and leg band portions to prevent leakage. Often, the elastic portions promote better form fitting and/or fastening systems for a good combination of comfort and reliability. The inventive elastic fibers and fabrics disclosed herein can also produce structures which combine elasticity with breathability. An inexpensive elastic fabric of the present invention can be economical and considered for coverstock applications for improved comfort, fit, feel, and protection.

Elastic material or elastic-like material typically refers to any material having a root mean square average recoverable elongation of about 65% or more based on machine direction and cross-direction recoverable elongation values after 50% elongation of the web and one pull. The extent that a material does not return to its original dimensions after being stretched and immediately released is its percent permanent set. According to ASTM testing methods, set and recovery will add to 100%. Set is defined as the residual relaxed length after an extension divided by the length of extension (elongation). For example, a one inch gauge (length) sample, pulled to 200% elongation (two additional inches of extension from the original one inch gauge) and released might a) not retract at all so that the sample is now three inches long and will have 100% set $((3''_{end}-1''_{initial})/2''_{extension})$, or b) retract completely to the original one inch gauge and will have 0% set $((1''_{end}-1''_{initial})/2''_{extention})$, or c) will do something in between. An often used and practical method of measuring set is to observe the residual strain (recovery) on a sample when the restoring force or load reaches zero after it is released from an extension. This method and the above method will only produce the same result when a sample is extended 100%. For example, as in the case above, if the sample did not retract at all after 200% elongation, the residual strain at zero load upon release would be 200%. Clearly in this case set and recover will not add to 100%.

Continuous elastic filaments as described herein could also be used in woven applications where high resilience is desired.

The inventive elastic fibers and fabrics disclosed herein with adjustments in molecular weight or amount of vinyl aromatic component or ODT or all of these, also have adjustable tenacity and retractive force. Such capabilities and characteristics enable extensive design flexibility, for example, to provide for variable retractive forces in the same garment, if desired. Fabricated articles which can be made using the inventive elastic articles disclosed herein include composite fabric articles (e.g., disposable incontinence garments, training pants and diapers, especially pull-up diapers) that are comprised of one or more elastic components or portions. The inventive elastic articles disclosed herein can also produce fabric composite structures which combine elasticity with breathability.

The inventive elastic articles described herein can also be used to make breathable portions or breathable elastic composite materials.

The following examples are provided to illustrate the present invention but are not intended to limit the scope of the invention.

Experimental Methods

Dynamical Mechanical Spectroscopy—ARES:

Materials were characterized and screened using the Rheometric Scientific's Advanced Rheometric Expansion System (ARES):

In the examples, the materials were tested via a "Dynamic Temperature Ramp Test" with testing environment/conditions as follows:

Nitrogen atmosphere
7.9 mm Parallel Plates
Frequency of 1.0 radians/second
Initial temperature 60° C.
Final temperature 275° C.
Temperature increments of 5° C./minute
Soak time of 30 seconds
Strain 1.0%

Figure 1B:
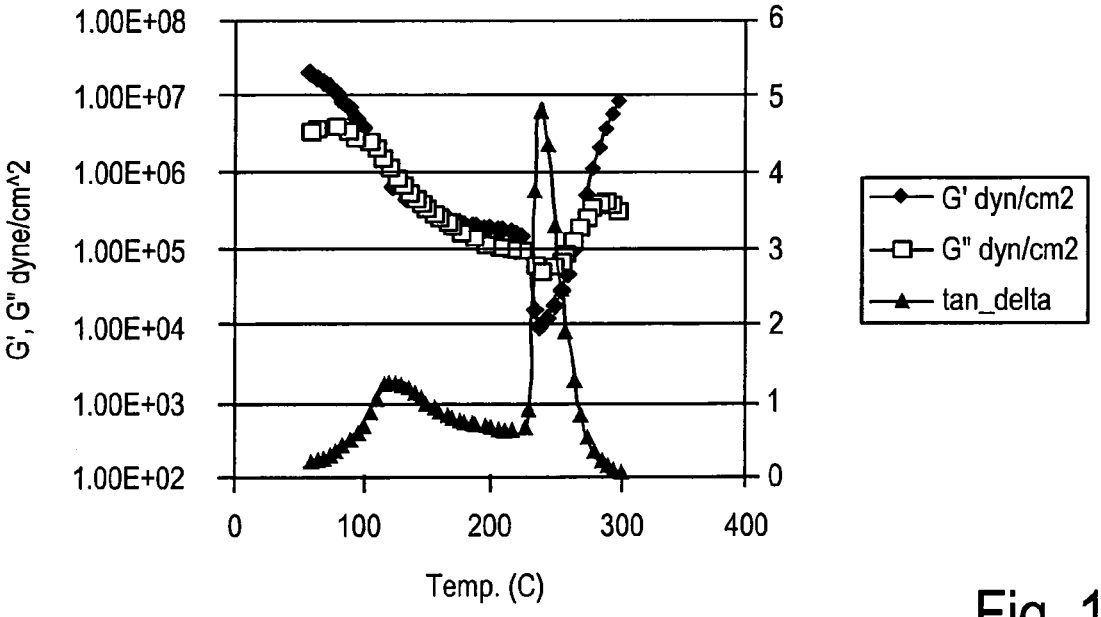

The 7.9-mm (diameter) parallel plates were brought together and zeroed at a temperature of 60° C. The sample was then placed onto the lower plate using tweezers. The upper plate was then lowered until it came in contact with the sample and a slight normal force (20 gm*cm) was applied. The temperature was then increased to above the $T_m$, in order to aid adhesion between the plates and the sample. Once the sample temperature was stable at the elevated temperature the auto-tension (hold) function was utilized to ensure steady/constant contact between the plates and sample while the temperature was decreased to the starting temperature of 60° C. Once the temperature equilibrated at 60° C., the test started. The Dynamic Temperature Ramp Test swept through a temperature range beginning at 60° C. and increased by 5° C. every minute until a final temperature of 275° C. or higher was reached. At each temperature increment, a "soak" time of 30 seconds was allotted to ensure stable temperature conditions prior to each measurement. During each measurement the lower plate was rotated in a sinusoidal manner at a frequency of 1 radian per second, while the degree of deformation applied to the material (strain) was set to 1.0%. Outputs of the test versus temperature were elastic shear modulus, G', shear loss modulus, G", and the loss tangent (G"/G'). Examples of an inventive material (Vector 4111, Example 1) and a comparative material (a triblock SBS, Vector 8508, Comp. Example 1) which were screened by the ARES technique are shown in FIGS. 1A and B, respectively. Note that in FIG. 1B a monotonic increase is seen for G' and G" at a temperature of 240° C.

Gottfert Rheograph Capillary Rheometer

Fiber spinnability was performed on a Gottfert Rheograph. The Gottfert Rheograph 2003 consists of a barrel containing three heating zones, a force transducer to monitor polymer melt pressure, a capillary die of varied orifice diameter and length, and a variable speed plunger to push polymer melts at constant or varied speeds. Each polymer was processed at a set experimental condition with temperature changes to facilitate optimum process conditions, or in this case, maximum spinning rate. The fiber processed from the Rheograph 2003 was collected on a high-speed godet. Speeds were regulated by the rpm of the roller. The capillary die (0.5 mm, L/D=5), and plunger speed (0.147 mm/s, or a polymer flow rate of 1 g/min) were kept constant. Temperature was changed to optimize maximum fiber collection speed on the high-speed roller apparatus. The relative break velocity measured by the capillary rheometer can be used to assess spinnability in textile processes.

Instron Tensile Tester

An Instron Tensile testing device was used to measure stress vs. strain for fiber tows (yarns) or nonwoven spunlaid fabrics. A low force load cell (either 11 N or 500 N), low weight manual grips, and a tensile measurement program (using Series IX or Merlin control programs provided by Instron Corp.) were used to determine tensile properties. For fiber tows from the capillary rheometer (Table 1), a 2-cycle program was used. Each cycle extended the tow 95% (1.9 inches) and % Recovery was determined from (1—% Set), where % Set was determined by the % Extension at zero load during retraction of the second cycle. The value of Ef(95)was determined from the peak load of the second cycle (force at 95% extension). The tensile values for. the retractive forces, Rf(70), Rf(50), and Rf(30), were all determined from the force during retraction of the second cycle at extensions of 70%, 50% and 30%, respectively. All tensile forces for fiber tows were normalized to an equivalent, 50 gram/cm$^2$ (gsm)×3" wide fabric, assuming that all the fibers were oriented in one direction (test direction). Specifically, a factor is applied (divided into) the measured force to normalize it to the equivalent force for a 3" wide×50 gsm fabric constructed of those same fibers (all oriented in the measured direction). Thus, the linear density (LD) for the fiber tow is measured as weight in grams divided by its length in meters. The LD is equivalent to the basis weight (BW) of a hypothetical fabric, considered whereby a 1 m long tow has been spread out to cover 1 m of width. The normalizing factor (nf) is computed as:

$$nf=(LD/50\text{ gsm})\times(100\text{ cm/m}/2.54\text{ cm/in}/3\text{ in width})=LD/3.81$$

and the normalized force, Fn, as given in the table (Table 1d), is computed from the measured force, Fm, via:

$$Fn=Fm/n$$

% Recovery was determined for the fabric samples (Table 2) by a tensile test where the 2"×4" sample was extended once to 50% (2"), retracted to zero extension, rested for 1 minute, then extended to >zero load (0.01 N) (% Ext2). % Recovery is given as: (1—(% Ext2/50%)). Basis weight of the fabric was determined from the weight of the actual punched-out sample or an average weight of many large pieces taken from a production roll.

Figure 2A:
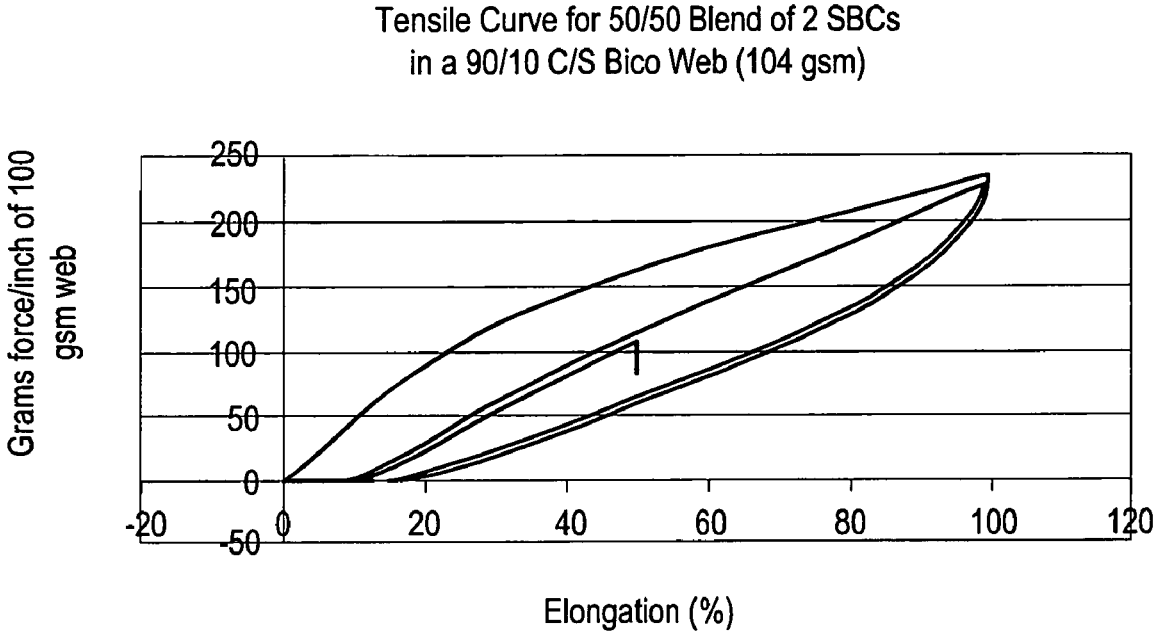
FIGS. 2A and 2B illustrate the normalized, 100% extension and recovery curve for two different basis weight fabrics made from an inventive SBC spunbond (as per examples 26 a and b).
Figure 2B:
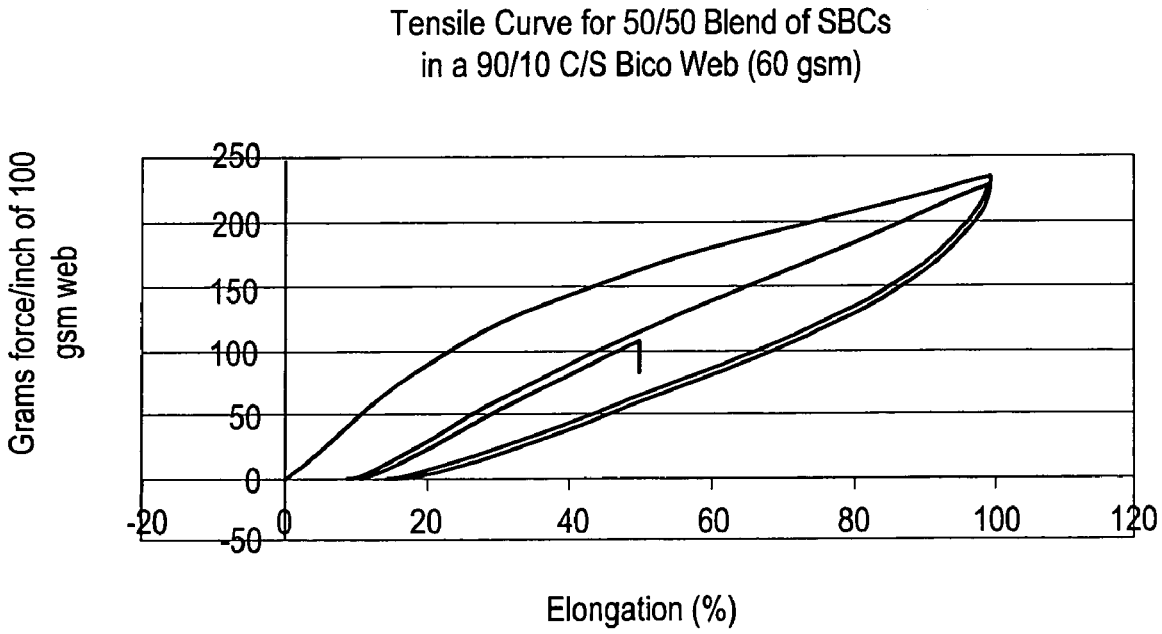

Another measurement frequently made on the Instron tensile testing machine is stress relaxation. Stress relaxation is a measurement of the rate or degree that stress is relieved in a material after being subjected to a certain strain. What is typically reported is the amount or % stress that is relaxed over some period of time. There are many ways to measure stress relaxation in the art. Examples 18 through 22 use a strain of 50% and a duration of relaxation of 1 minute. In most cases the webs are directly strained to 50% and tested for stress relaxation, while in other cases the webs were first subjected to 2 cycles of extension and relaxation prior to measurement (2 Cycle test, FIG. 2).

Experimental Production of Webs

Generic Spunlaid Laboratory-Scale Line

Filaments are produced by extruding a polymer using a ¾ inch diameter extruder which feeds a gear pump. The gear pump pushes the molten polymer through a spin pack containing a series of woven metal filter and a 144 hole spinneret. The spinneret holes have a diameter of 0.400 mm and a land length of 1.6 mm (i.e. length/diameter ratio of 4/1). The gear pump is operated such that about 0.4 grams of polymer are extruded through each hole of the spinneret per minute. The melt temperature of the polymer is measured prior to entering the melt pump.

In the case of bicomponent filaments, a second extruder and gear pump are used to advance a second polymer to the spin pack. Spin packs for extruding bicomponent filaments are known and are not described here in detail. A spin pack design especially suitable for practicing this invention in described in U.S. Pat. No. 5,162,074. The spin pack includes a plurality of plates stacked on top of one another and arranged to create separate flow paths for the two polymer components.

After exiting the die the filaments are subjected to a flow of quench air to facilitate solidification of the polymer. The quench air rate is low enough so that it can barely be felt by hand in the area below the spinneret. The filaments are advanced by a compressed air draw device similar to one described in U.S. Pat. No. 5,225,018. The filaments leaving the draw device are collected in a loose web on a foraminous surface. Individual filament tows can alternatively be collected for laboratory evaluation.

Figure 3:
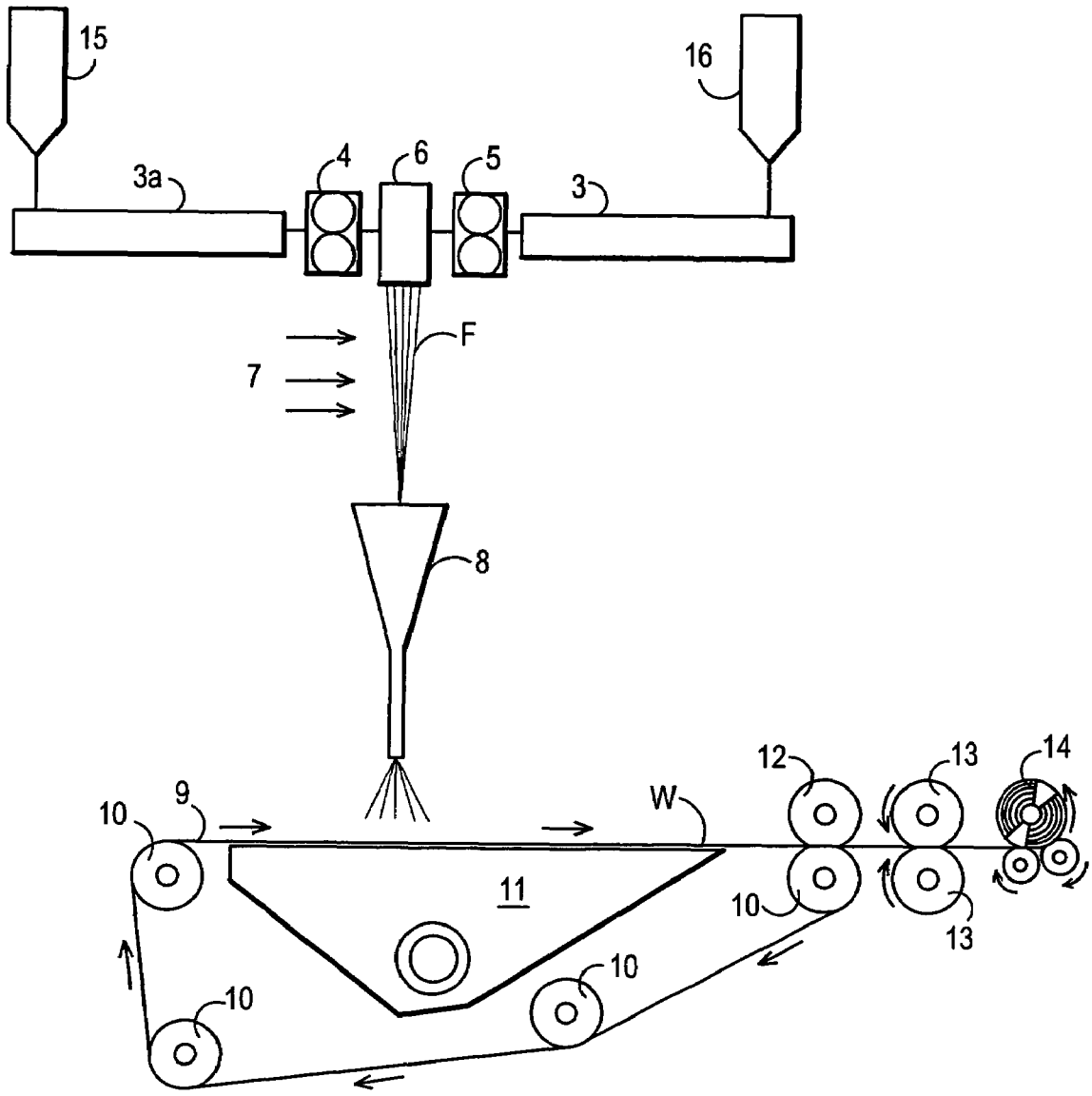
FIG. 3 shows a block diagram of a generic spunbond system.

An example of a pilot or commercial-scale apparatus for producing spunlaid nonwovens is illustrated in FIG. 3. This apparatus is outfitted with two extruders (3*a* and 3) and two gear pumps (4 and 5) so that it has the capability of producing webs from bicomponent filaments. However, it can be used to produce webs of monocomponent filaments by operating only one extruder or by processing the same polymer in both extruders. A downwardly extending curtain of filaments is extruded from spinneret 6. A quench blower 7 positioned adjacent to the curtain of filaments facilitates the solidification of the polymers.

A filament draw unit or aspirator 8 is positioned below the spinneret 6 and receives the quenched filaments. Generally described, the filament draw unit 8 includes an elongate vertical passage through which the filaments are drawn by aspirating air entering from the sides of the passage. The aspirating air advances the filaments and ambient air through the fiber draw unit.

An endless foraminous surface 9 is positioned below the fiber draw unit 8 and receives the continuous filaments from the outlet opening of the fiber draw unit. The forming surface 9 travels around guide rollers 10. A vacuum 11 positioned below the forming surface 9 where the filaments are deposited pulls the filaments against the forming surface and removes back-drafts.

The apparatus further includes a compression roller 12 that, along with the forward most guide rollers 10 receive the web as it is drawn off the forming surface 9. In addition, the apparatus includes a pair of thermal bonding calendar rolls 13 for bonding the filaments together and integrating the web to form a finished fabric. Lastly, the apparatus includes a winder 14 for taking up the finished fabric.

To operate the apparatus, the hoppers 15 and 16 are filled with the respective first and second polymer components which are melted and extruded by the respective extruders 3*a* and 3 through melt pumps 4 and 5 and the spinneret 6. Although the temperatures of the molten polymers vary depending on the polymers used, when, for example, Vector 4111 and Dow 6811A LLDPE are used as the first and second components of a bicomponent filament, the Vector 4111 enters the spin pack at a temperature of ~270° C. and the Dow 6811A enters the spin pack at a temperature of 220° C. The temperature of the spinneret face is 260° C.

As the extruded filaments extend below the spinneret 6, a stream of air from the quench blower 7 at least partially quenches the filaments. After quenching, the filaments are drawn into the vertical passage of the draw unit 8 by a flow of air through the draw unit. The drawn filaments are deposited through the outer opening of the draw unit 8 onto the traveling forming surface 9. The vacuum 11 draws the filaments against the forming surface 9 to form a nonwoven web of continuous filaments. The web is then lightly compressed by the compression roller 12 and thermal point bonded by bonding rollers 13. Thermal point bonding techniques are well known to those skilled in the art and are not discussed here in detail.

However, it is noted that the type of bond pattern may vary based on the degree of fabric strength desired. The bonding temperature also may vary depending on factors such as the polymers in the filaments.

Although the method of bonding shown in FIG. 3 is thermal point bonding, it should be understood that the fabric of the present invention may be bonded by other means such as oven bonding, ultrasonic bonding, hydroentangling or combinations thereof to make a cloth-like fabric.

Lastly, the finished web is wound into a roll on the winder 14 and is ready for further treatment or use.

EXAMPLE 1 TO 7 AND COMPARATIVE EXAMPLE 1

The tables below (Tables 1a, b) present the $M_w$, % styrene, ODTs and capillary rheometry data for fiber tows prepared from various commercial SBCs. Also presented in the table are classifications of each SBC. The tables show that materials with ODTs below 280° C. may be processed at a variety of temperatures to yield fibers drawn at high velocities. Most of the materials presented in these examples are pure SBCs (some also contain residual diblock). It is anticipated that process aids will allow for lower temperature processing, faster fiber velocities, or different fiber performance, as can be seen in Example 5. The comparative example shows that butadiene-based soft blocks are difficult to spin at commercial rates. In Comparative Example 1 (see also FIG. 1B) a monotonic increase in the modulus is seen at 240° C., indicative of cross-linking in this SBC polymer. Many different classes of compounds have been investigated, as well as widely varied molecular weights (~60 to 150 kg/mole) and % styrene (11 to 45%). In fact both methods of producing SBCs (Sequential and Coupled) are represented in the table. In all Exemplary cases, where the fibers are drawn (not strands, which are typically 100-300 microns), the diameters of the fibers making up the tows were less than 100 microns. It is anticipated that spinning on commercial extrusion equipment and fiber spinning lines will be possible at no less than the rates presented in Table 1b, and probably faster.

TABLE 1a

Material properties of commercial SBCs. ODTs less than 125° C. are difficult to determine due to the $T_g$ of the styrenic block.

| Commercial Name | Example | % Styrene | $M_w$ kDalton | ODT ° C. | Material Design (Classification) |
|---|---|---|---|---|---|
| Vector ™ 4111** | 1 | 18 | 130 | 205 | Linear SIS |
| Vector ™ 4211** | 2 | 29 | 100 | 266 | Linear SIS |
| Vector ™ 4411** | 3 | 44 | 77 | 277 | Linear SIS |
| Vector ™ 4213** | 4 | 25 | 116 | 276 | Linear SIS + 25% SI diblock |
| Vector ™ 4411** + 25% Mineral Oil | 5 | 44 | 77 | 227* | Linear SIS (Ex 3) + 25% Mineral oil |
| Kraton 1107 | 6 | 15 | 160 | 190 | Coupled Linear SIS (+17% SI) |
| Enichem's SOL-T 9113 | 7 | 18 | 126 | 196 | Coupled Linear SIS (+12% SI) |
| Vector 8508 | Comp. 1 | 29 | 75 | 226 | Linear SBS |

Vector block copolymers are supplied by Dexco, a Dow/Exxon Joint Venture Company.
*May be an OOT (Order-Order Transition) but enables lower temperature spinning like an ODT.
**Mw for Vector ™ elastomers are approximate.

TABLE 1b

Capillary rheometer fiber spinning conditions for commercial SBC polymers and recovery of elasticity for the formed fiber tows following 2 cycles to 100% elongation.

| | Capillary Rheometer | | Recovery |
|---|---|---|---|
| Example | Temp., C. | Vel., m/min | % |
| 1 | 270 | 390 | 81 |
| 2 | 250 | 150 | 95 |
| 3 | 270 | 480 | 80 |
| 4 | 260 | 300 | 92 |
| 5 | 250 | 540 | 91 |
| 6 | 285 | 150 | 73 |
| 7 | 275 | 420 | 95 |
| Comp. 1 | 230 | <30 | |

EXAMPLES 8-17 AND COMPARATIVE EXAMPLES 2-4

Table 1c presents a broad spectrum of SBC polymers of the present invention (Examples 8-17) and some comparative examples (butadiene-dominant SBCs and an isoprene-based SBC with too high an ODT). These fibers are monocomponent filaments spun on a capillary rheometer. All inventive examples had good recoveries, while the comparative samples could not be spun into fibers (<400 micron diameter) or produced a fiber of low elasticity (low recovery).

TABLE 1c

Material properties and fibers produced via capillary rheometer for experimental SBC polymers. Recovery is measured in these examples after 2 cycles to 100% elongation. ODTs near 100-125 C. are difficult to determine due to the $T_g$ of the styrenic block.

| Example | Styrene % | $M_w$ kDalton | ODT ° C. | Capillary Rheometer Temp., C. | Vel., m/min | Recovery % | Material Design (Classification) |
|---|---|---|---|---|---|---|---|
| 8 | 14.5 | 138 | 140 | 230 | 300 | 90 | Linear SISI Quad |
| 9 | 11 | 140 | 125 | 200 | 300 | 96 | Linear SIS |
| 10 | 16 | 106 | ~100 | 170 | 330 | 91 | Linear SISI Quad |
| 11 | 16 | 93 | 110 | 190 | 420 | 96 | Linear SIS |
| 12 | 32.8 | 61.8 | 185 | 220 | 300 | 88 | Linear SIS |
| 13 | 31 | 64.5 | 185 | 205 | 450 | 86 | Linear asymmetric SIS |
| 14 | nd | nd | nd | 230 | 450 | 87 | Two Linear SIS blend (1 & 10) |
| 15 | 45 | 75 | ~280 | 280 | 450 | 78 | Linear SIS |
| 16 | 45 | 71 | 274 | 280 | 600 | 73 | Linear SIS |
| 17 | 35.8 | 65.6 | 226 | 245 | 600 | 88 | Linear asymmetric sIS |
| Comp 2 | 29 | 73 | 130 | Would not spin | | | SBSB Quad block |
| Comp 3 | 30 | nd | * | Would not spin | | | $(SB)_4$ Star + SB diblock |
| Comp 4 | 40 | 188 | 290 | 310 | 300 | 63 | Linear tapered asymmetric s(IS)t |

*Could not be analyzed, possibly due to cross-linked skin on plaque after compression molding.
nd = not determined.

EXAMPLES 18-22, TABLE 1d

Materials 18 to 22 were spun as mono- or bicomponent fiber tows and were drawn with either a Lurgi-style air draw system or velocity controlled draw roll (godet). Materials 18 and 19 were commercial materials, except that the compositions were modified, and include an oil. In the compositions containing oil, the oil was added by mixing the elastomer resin pellets with the oil so that the oil would absorb into the pellets until essentially dry to the touch (e.g., 1 week at room temperature).

Material 20 is an example of a pentablock SBC showing excellent fiber tensile properties as well as good spinnability and process temperature. The fiber diameter in this example, produced at low draw velocity, is 33 microns. The polyethylene sheath used in this example had a density of approximately 0.93 g/cc. Soft sheath materials, like PE (especially of low density), seem to produce better bicomponent fibers with SBC elastomers.

Materials 21 and 22 are low $M_w$ triblock SBCs that show excellent fiber properties as pure elastomers (monocomponent). They have ODTs of 180° and 216° C., respectively. These filaments were spun on the capillary rheometer. The asymmetric triblock (22) has styrene block lengths of 7.6 and 11.4 kDaltons.

TABLE 1d

Homopolymer and bicomponent fibers produced from advantageous SBC polymers of the present invention.

| Composition | Construction | Form | Process Temp ° C. | Rf(95) g | Rf(70) g | Rf(50) g | Rf(30) g | Set % | SR % |
|---|---|---|---|---|---|---|---|---|---|
| 18. 4211 + 30% Mineral Oil | Homofilament no die, no draw | Lab SB strand bundle | 250 | 232 | 175 | 143 | 99 | 3 | 3.4 |
| 19. 4211 + 30% Mineral Oil//PP | 90/10, S/C, Lurgi drawn | Lab SB fiber tow | 235 | 367 | 190 | 134 | 50 | 12 | 6.5 |
| 20. Penta-block (25% S, 109 $kM_w$)/PE | 90/10, S/C, Lurgi fiber tow | Lab SB fiber tow | 220 | 432 | 250 | 161 | 53 | 13.9 | 18.8 |
| 21. Asym. triblock (28% S, 68.1 $kM_w$) | Homofilament 0.5 mm die, 500 m/min draw | Rheo-meter filament bundle | 195 | 513 | 375 | 290 | 177 | 11 | 9.7 |

TABLE 1d-continued

Homopolymer and bicomponent fibers produced from advantageous SBC polymers of the present invention.

| Composition | Construction | Form | Process Temp ° C. | Rf(95) g | Rf(70) g | Rf(50) g | Rf(30) g | Set % | SR % |
|---|---|---|---|---|---|---|---|---|---|
| 22. Sym. Triblock (31% S, 73.8 $kM_w$) | Homofilament 0.5 mm die, 240 m/min draw | Rheometer filament bundle | 250 | 406 | 266 | 186 | 100 | 12 | 13.9 |

Lab SB is the spunbond lab line described above, but used to make filaments only. All values in Table 1d are normalized for a 50 gsm fabric 3" wide; all fibers align in the MD. "4211" refers to a VECTOR copolymer.

EXAMPLES 23 TO 35

Table 2 presents spunlaid nonwovens produced from bicomponent filaments where up to 96% of the fiber is an elastic SBC of the present invention (not presented are fabrics we have produced of 100% elastic fibers, since these fabrics have a more rubbery hand than desired). In each case the bond temperature is much below that found/required for fibers of similar construction but using non-SBC, and especially non-elastomeric components. All these fabrics are elastic with >65% recovery when extended to 50% elongation. In addition all fabrics have a soft, cloth-like hand that is unique from the individual components of the fiber. All fiber diameters are below 50 microns. Two types of bicomponent structures are shown here: core/sheath (C/S) and tipped trilobal (T/T). Three types of draw system are also shown: S-Tex, a low velocity slot method (≧500 m/min); Lurgi gun, a high velocity forced air orifice (>750 m/min); and Reicofil 3 (RF3), a high velocity slot (≧1000 m/min). Basis weight (eg. 100 gsm, or grams/$m^2$) is set by the speed of the take-up belt (eg. ~30 m/min) and the throughput of the material (eg. 0.5 g/hole/min) and the number of holes/m in the die (eg. ~6000 holes/m). Some of the specific data show: fabrics with low ratios of elastic component are only elastic (≧65% recovery) when activated by yielding (stretching) the non-elastic component (cf. Ex 29 vs 30); fabrics can be made from mixtures of SBC (i.e. Ex 25, 26, 34, and 35); low basis weight materials have as good a recovery as high basis weight materials(cf. Ex 33 vs 32); and a very economical and widely used spunlaid method, Reicofil 3, can be used to produce fabrics of this invention (i.e., Ex 31-35).

TABLE 2

Spunbonded nonwovens produced from SBC elastomers. Recovery is determined by the Load Onset after 1 cycle to 50% extension + 1 minute rest at 0% extension. All S-TEXand Lurgi gun formed fabrics have been stretch activated by incremental stretching at RT, unless otherwise noted. All measurements are made on fabrics in the Machine Direction (MD) unless specified as Cross Direction (CD).

| Patent Example | Construction | Bond Temp. C. | Basis Weight gsm | Recovery % |
|---|---|---|---|---|
| 23 | 95/5 C/S, C = Vector 4111, S = PP, S-TEX, not stretch activated | 70 | 150 | 95 |

TABLE 2-continued

Spunbonded nonwovens produced from SBC elastomers. Recovery is determined by the Load Onset after 1 cycle to 50% extension + 1 minute rest at 0% extension. All S-TEXand Lurgi gun formed fabrics have been stretch activated by incremental stretching at RT, unless otherwise noted. All measurements are made on fabrics in the Machine Direction (MD) unless specified as Cross Direction (CD).

| Patent Example | Construction | Bond Temp. C. | Basis Weight gsm | Recovery % |
|---|---|---|---|---|
| 24 | 96/4 C/S, C = Vector 4111, S = PE, S-TEX, not stretch activated | 70 | 200 | 95 |
| 25 | 90/10 C/S, C = 50% Vector 4111 + 50% Vector 4211, S = PP; S-TEX | 70 | 127 | 92 |
| 26a | 90/10 C/S, C = 50% Vector 4111 + 50% Vector 4211, S = PE; S-TEX | 70 | 104 | 96 |
| 26b | 90/10 C/S, C = 50% Vector 4111 + 50% Vector 4211, S = PE; S-TEX | 70 | 60 | 96 |
| 26c | 90/10 C/S, C = 50% 4111 + 50% 4211, S = PE; S-TEX, not activated | 70 | 130 | 86 |
| 27 | 60/40 T/T, C = Vector 4111, Tip = PE, Lurgi gun | 70 | 140 | 95 |
| 28 | 60/40 T/T, C = Vector 4111, Tip = PE, Lurgi, not stretch activated | 70 | 140 | 70 |
| 29 | 30/70 C/S, C = Vector 4211, S = PE, Lurgi | 70 | 95 | 80 |
| 30 | 30/70 C/S, C = Vector 4211, S = PE, Lurgi, not stretch activated | 70 | 95 | 60 |
| 31 | 90/10 C/S, C = Vector 4111, S = PP; RF3 slot, MD | 73 | 130 | 90 |
| 32 | 90/10 C/S, C = Vector 4111, S = PP; RF3 slot, CD | 73 | 130 | 88 |
| 33 | 90/10 C/S, C = Vector 4111, S = PP; RF3 slot, MD | 73 | 89 | 94 |
| 34 | 90/10 C/S, C = 74% Vector 4111 + 26% Vector 4211, S = PP; RF3, MD | 73 | 149 | 90 |
| 35 | 90/10 C/S, C = 74% Vector 4111 + 26% Vector 4211, S = PP; RF3, CD | 73 | 149 | 88 |

Bonding Experiments

EXAMPLES 36, 37 AND 38

Figure 4:
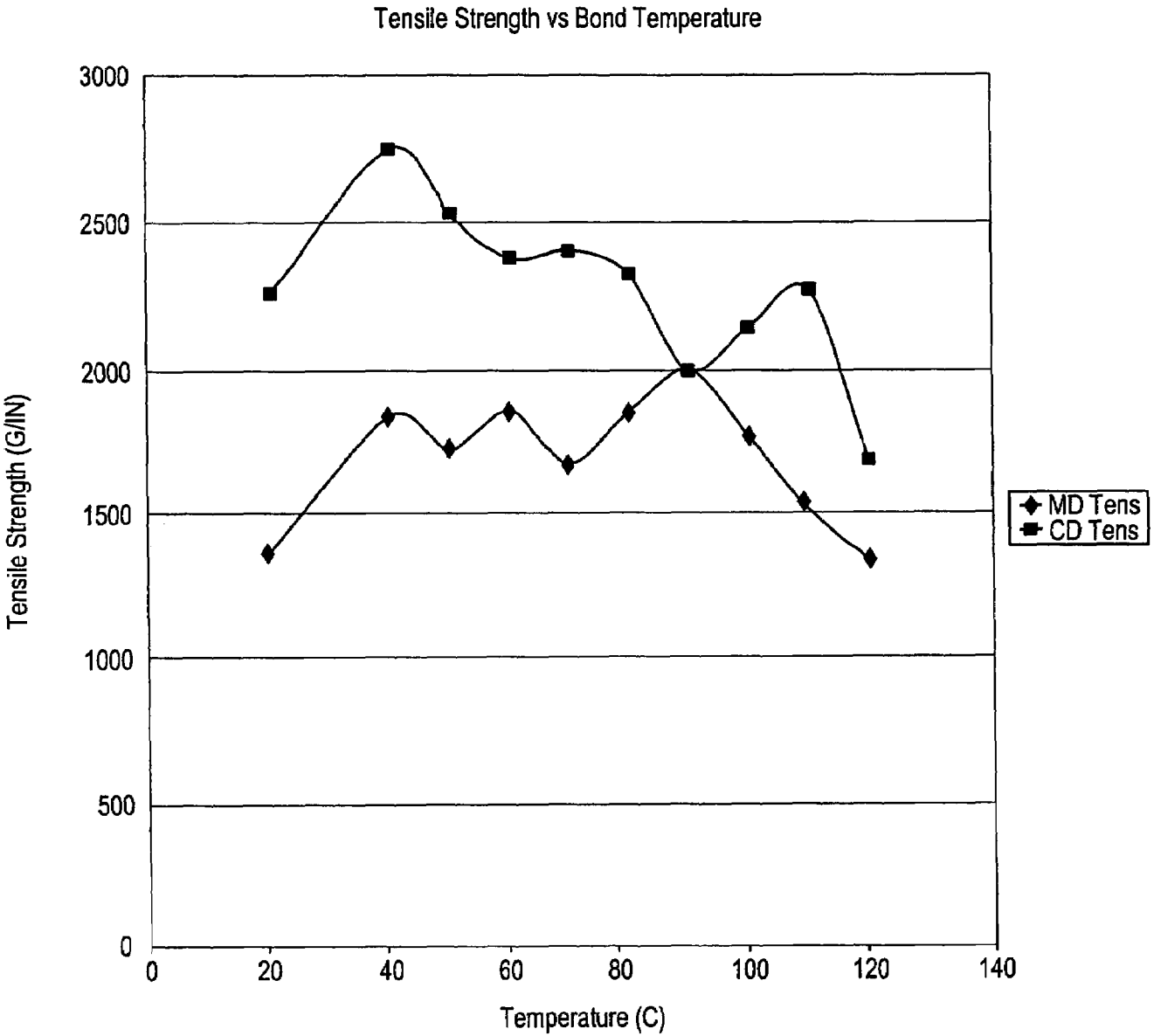
FIGS. 4-6 show plots of tensile strength versus bond temperature from examples 36-38, respectively.
Figure 5:
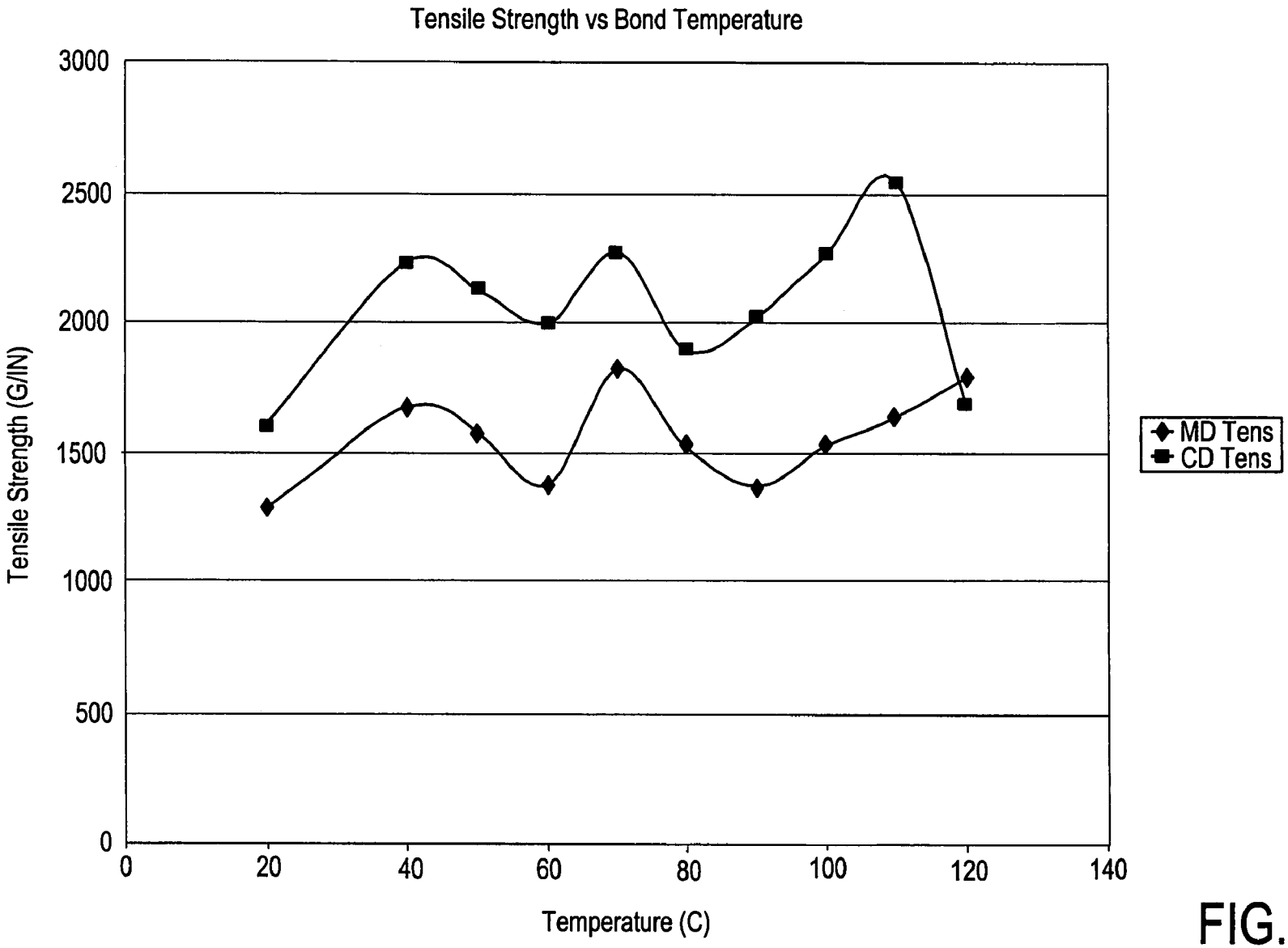
Figure 6:
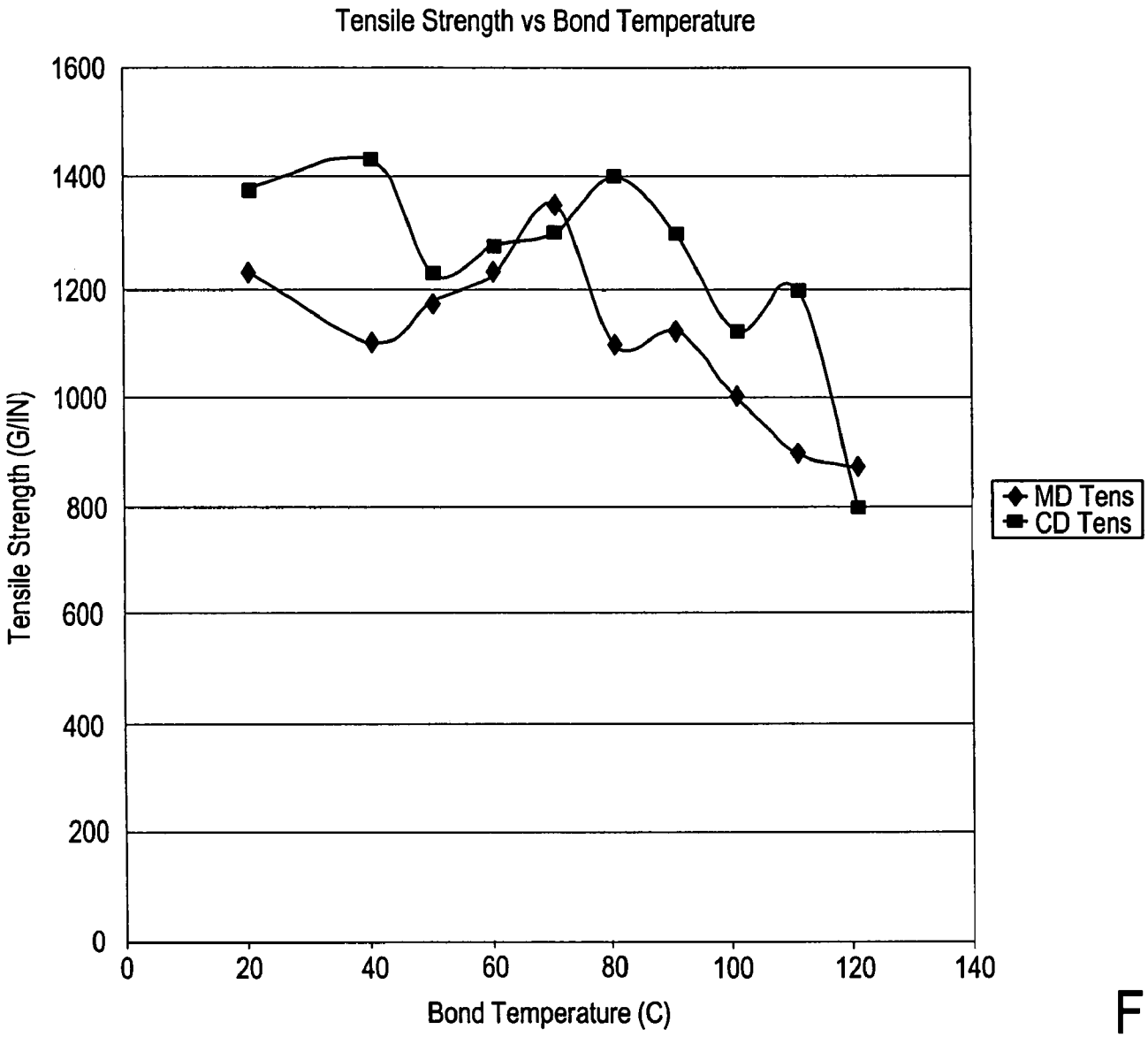

Examples 36, 37 and 38 were prepared on an apparatus similar to the one described above (and schematically shown in FIG. 3). However, this particular apparatus did not have a thermal bonding calendar 13. It was possible to prepare webs of sufficient strength for winding by pressing the webs against the forming wire using compaction roll 12. The filament drawing device used for these examples was similar to the device described in U.S. Pat. No. 5,225,018. The composition of the examples is given in Table 3. Pieces of the compacted webs were processed through a thermal point bonding calendar in order to determine the effect of bond temperature on fabric strength. The results are presented in FIGS. 4 to 6. The fabrics achieve their maximum tensile strengths at temperatures far below the typical bonding temperature of the polyethylene sheaths of the filaments. The recovery from 100% elongation and the stress relaxation after 5 minutes at 50% elongation for the bonded samples are given in Table 3.

EXAMPLES 39, 40, AND 41

Figure 7:
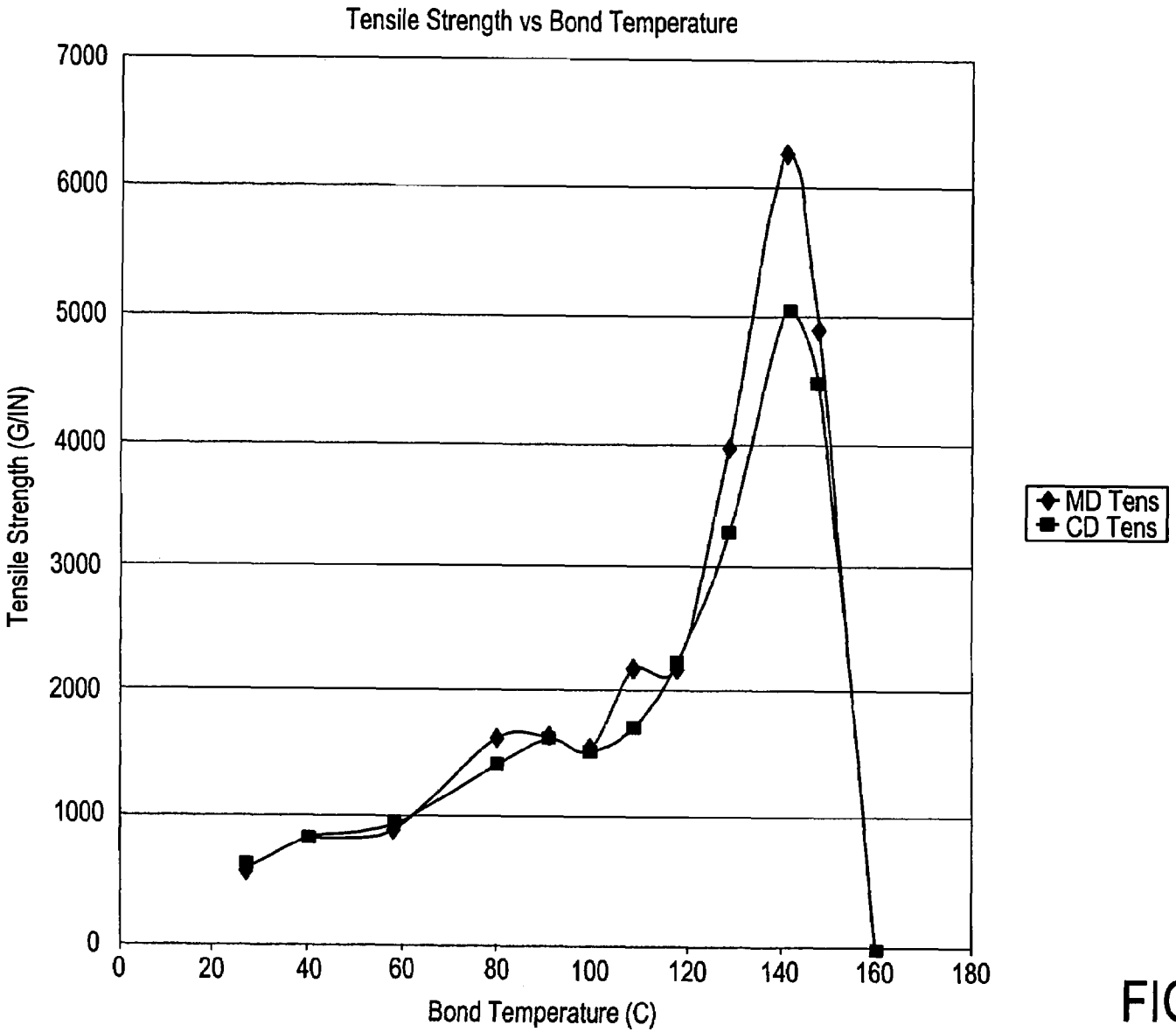
FIGS. 7-9 show plots of tensile strength versus bond temperature for examples 39-41, respectively.
Figure 8:
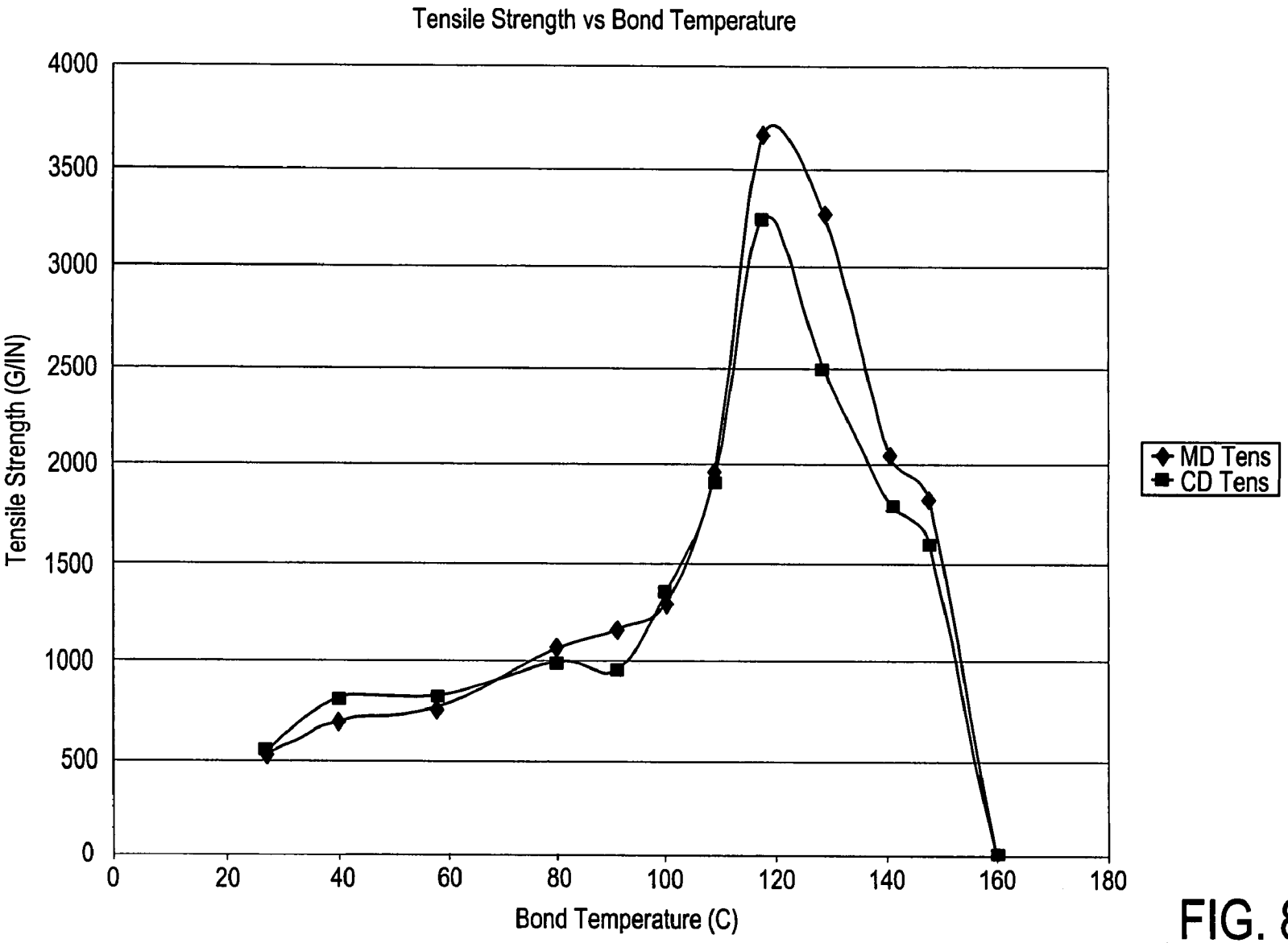
Figure 9:
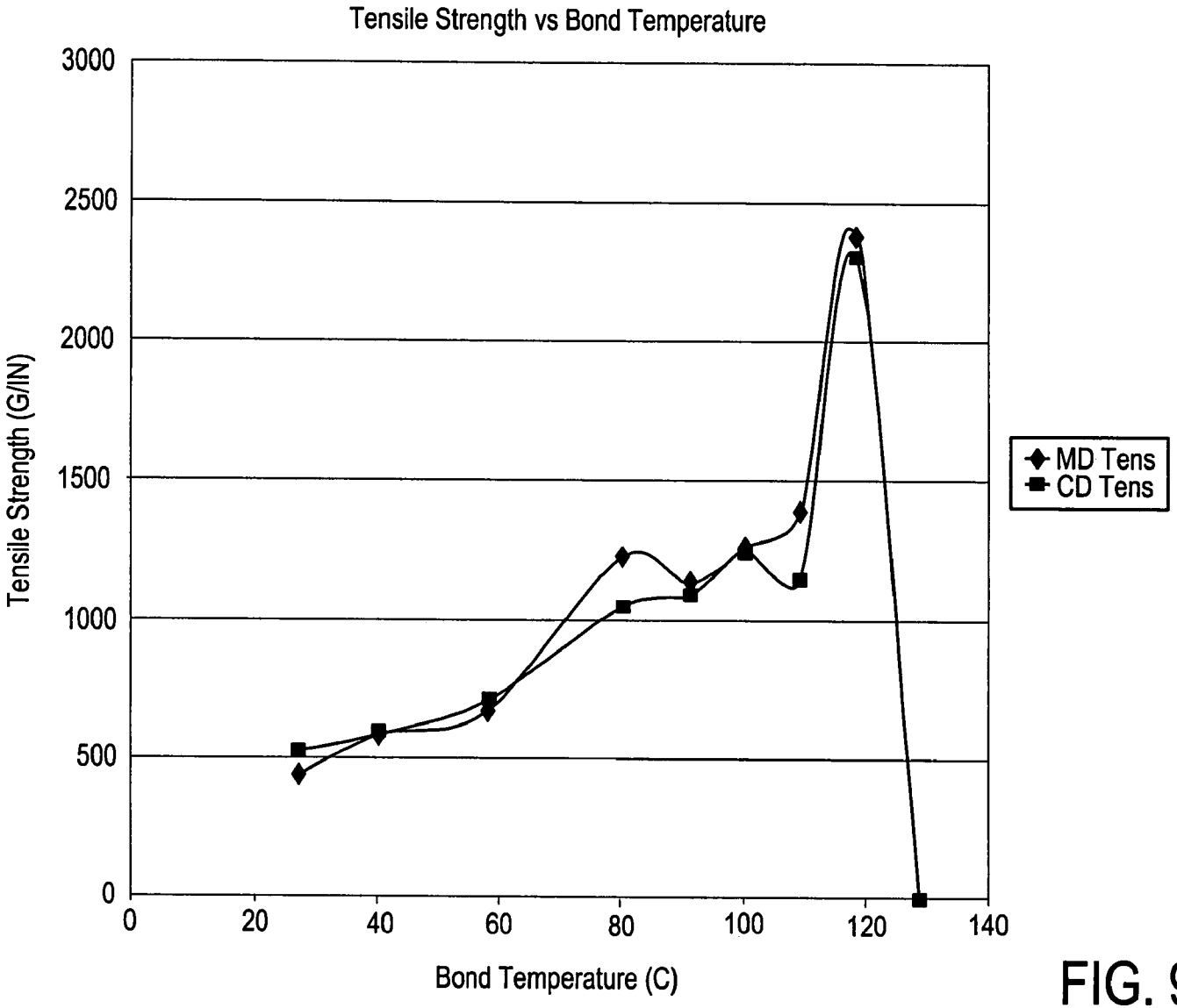

Examples 39, 40 and 41 were prepared on the same apparatus as Examples 36-38. The composition of the webs is described in Table 4. The webs were wound up in compacted form. Pieces of the samples were processed through a thermal point bonding calendar in order to determine the effect of bond temperature on fabric strength. The results are presented in FIGS. 7 to 9. The fabrics achieve their maximum tensile strengths only at temperatures close to the melting points (i.e., the typical bonding temperatures) of the PE and PP components.

EXAMPLES 42 AND 43

Figure 10:
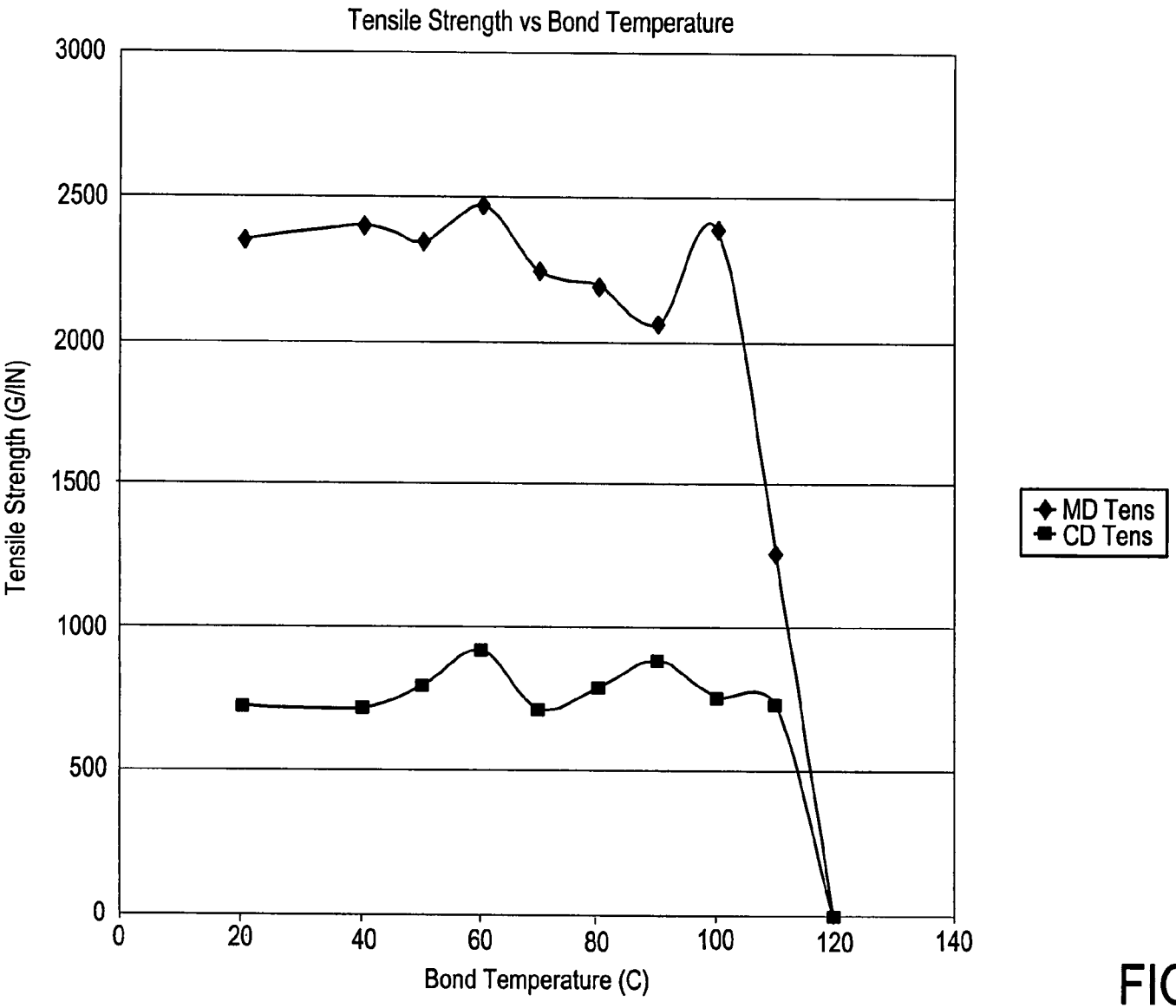
FIGS. 10 and 11 show plots of tensile strength versus bond temperature for examples 42 and 43, respectively.
Figure 11:
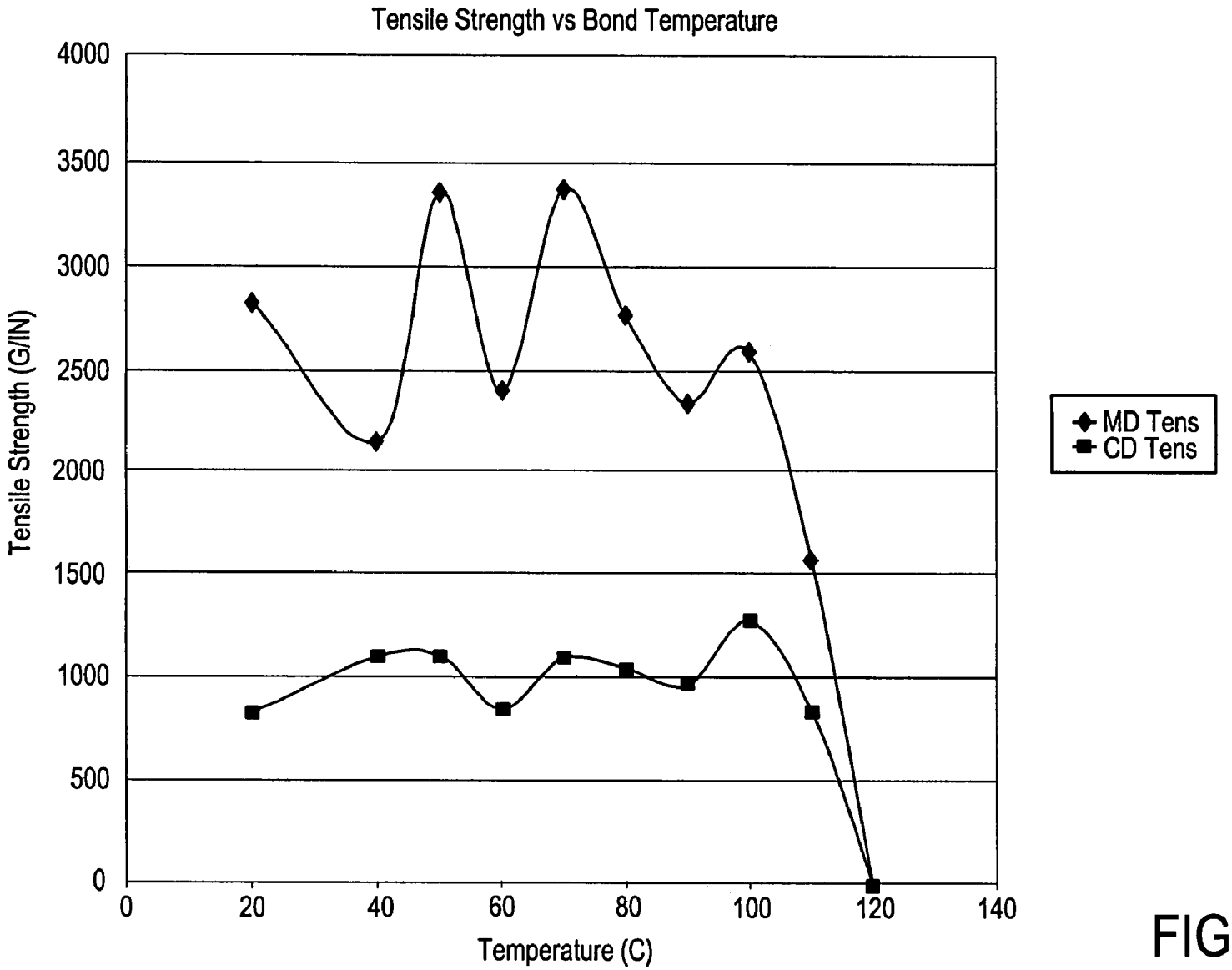

Examples 42 and 43 were prepared on an apparatus similar to the apparatus described in FIG. 3. However, in this case a system known as S-Tex process and described in U.S. Pat. No. 5,985,776 (FIG. 3) was used to draw the filaments. This device does not employ compressed air to entrain the filaments but instead relies on a vacuum created beneath the forming wire 9 to draw the filaments. Although this web forming apparatus was outfitted with a thermal point bonding calendar, this was left in the open position. The pressure of the compaction roll 12 against the forming wire 9 was sufficient to give the webs strength so that they could be transported to the winder. The composition of the examples is given in Table 5. Pieces of the compressed webs were processed through a thermal point bonding calendar in order to determine the effect of bonding roll temperature on fabric strength. The results are presented in FIGS. 10 and 11. The fabrics achieve their maximum tensile strengths at temperatures far below the typical bonding temperature of the polyolefin sheath components. The recovery from 100% elongation and stress relaxation after 5 minutes at 50% elongation for the bonded samples are given in Table 5.

EXAMPLE 44

Example 44 was prepared on an apparatus similar to the apparatus described in FIG. 3. However, in this case the filament drawing device was a slot similar to the draw slot described in U.S. Pat. No. 5,814,349. This device does not employ compressed air to entrain the filaments but instead relies on an enclosed quench box and the vacuum created beneath the forming wire. This particular spunbond process is called Reicofil III (RF3) by the manufacturer—Reifenhauser GmbH. Example 44 was thermal point bonded in-line at a temperature of 73° C. The filaments had a sheath/core cross section with 10% sheath and 90% core by weight. The core was composed of 85% Vector™ 4111 and 15% Vector™ 4211 by weight. The sheath was composed of 100% polypropylene. The temperature of the molten polymers entering the extrusion die was: Vector blend, 281° C.; polypropylene, 246° C. The basis weight of the bonded fabric was 135 gsm and the filaments had an average of 5.5 denier. The mechanical properties of the fabric are described in Table 6.

TABLE 3

| Example Number | Composition | Basis Weight gsm | Filament Denier | Recovery % | Stress Relaxation % |
|---|---|---|---|---|---|
| 36 | 50/50 Sheath/Core<br>Core -Vector 4211<br>Sheath - Dow 6811A | 105 | 8 | 65 | 43 |
| 37 | 70/30 Sheath/Core<br>Core - Vector 4211<br>Sheath - Dow 6811A | 110 | 8 | 60 | 41 |
| 38 | 30/70 Sheath/Core<br>Core - 50% Vector 4111<br>50% Vector 4211<br>Sheath - Dow 6811A | 100 | 8 | 70 | 45 |

TABLE 4

| Example Number | Composition | Basis Weight gsm | Filament Denier |
|---|---|---|---|
| 39 | 100% Dow 6811A LLDPE | 50 | 3 |
| 40 | 50/50 Sheath/Core<br>Core - PP<br>Sheath - Dow 6811A | 50 | 3 |
| 41 | 100% PP | 50 | 3 |

TABLE 5

| Example Number | Composition | Basis Weight gsm | Filament Denier | Recovery % | Stress Relaxation % |
|---|---|---|---|---|---|
| 42 | 5/95 Sheath/Core<br>Core -Vector 4111<br>Sheath - PP | 150 | 8 | 95 | 34 |
| 43 | 6/94 Sheath/Core<br>Core - Vector 4111<br>Sheath - Dow 6811A | 200 | 12 | 95 | 30 |

TABLE 6

| EXAMPLE 44 | |
|---|---|
| MD Tensile G/in | 1500 |
| MD Elongation % | 640 |
| CD Tensile G/in | 950 |
| CD Elongation % | 650 |
| MD Recovery % | 95 |
| CD Recovery % | 95 |
| MD Stress Relaxation % | 42 |
| CD Stress Relaxation % | 43 |

EXAMPLE 45

This example was prepared using the meltblowing process. Vector 4111 SIS was melted in an extruder and advanced to a meltblowing die. The tip of the die contained 320 orifices in a row of 25 cm length. The diameter of the orifices was 0.4 mm. The temperature of the polymer melt in the die was 278° C. The elastomer was extruded through the orifices at a rate of 0.3 grams per orifice per minute. The elastomeric filaments were attenuated by two streams of air directed by air knives located along the sides of the die tip. The temperature of the air was 278° C. The die tip and the ends of the air knives were located on the same horizontal level (zero "setback"). The web of elastomeric filaments was collected on a surface that was seamed to form a continuous loop passing underneath the meltblowing die. The foraminous surface was constructed of woven metal filaments that had been coated with Teflon. The web of elastomeric filaments was very "sticky" and adhered strongly to the foraminous surface. As a result, low basis weight webs could not be removed from the surface without destroying them. By passing the foraminous surface several times under the meltblowing die, it was possible to build up a web of sufficient strength to allow removal from the surface. The filaments in the web had an average diameter of 20 microns. The mechanical properties of this web are given in Table 7.

It was possible to prepare laminates using Example 45.

EXAMPLE 46

The piece of meltblown fabric described in Example 45 was placed between two similarly sized pieces of the spunlaid web described in Example 44. The difference between these spunlaid web pieces and the spunlaid fabric described in Example 44 is that these web pieces had not been thermal point bonded. The three layer spunbond-meltblown-spunbond "sandwich" was thermal point bonded at 50° C. to give a laminated fabric possessing stretch and recovery. This laminate was process through an incremental stretch device similar to the device described in U.S. Pat. No. 4,223,059. The bonded fabric was stretched in both the machine direction and cross machine direction. The stretching had the effect of softening the fabric while increasing its area and reducing its basis weight. The properties of this fabric (Example 46) are described in Table 7.

EXAMPLE 47

A piece of the meltblown fabric described in Example 45 was placed between two similarly sized pieces of a polyolefin spunbonded fabric of the type described in U.S. Pat. No. 5,804,286. This three layer spunbond-meltblown-spunbond "sandwich" was thermal point bonded at a temperature of 116° C. to give a relatively stiff, inelastic fabric. This fabric was stretched in both the machine and cross machine directions using an incremental stretching device. The stretching had the effect of softening the laminate and imparting stretch and recovery properties. The mechanical properties of this fabric are described in Table 7.

EXAMPLE 48

It is possible to prepare an elastic spunbond-meltblown-spunbond laminate using webs of spunlaid elastic filaments and an inelastic meltblown web. In this example, a 13 gsm web of polypropylene meltblown microfibers was placed between two layers of the unbonded web described in Example 44. The laminate was thermal point bonded at 126° C. to give a relatively stiff, inelastic fabric. This fabric was stretched in both the machine and cross machine directions using an incremental stretching device. The stretching had the effect of softening the laminate and imparting stretch and recovery properties. The mechanical properties of this fabric are described in Table 7.

TABLE 7

| | Example | | | |
|---|---|---|---|---|
| | 45 | 46 | 47 | 48 |
| Basis Weight gsm | 750 | 940 | 785 | 175 |
| MD Tensile G/in | 455 | 3245 | 3395 | 1420 |
| MD Elongation % | 620 | 705 | 145 | 175 |
| CD Tensile G/in | 325 | 2815 | 830 | 1050 |
| CD Elongation % | 535 | 570 | 290 | 315 |
| MD Recovery % | 95 | 95 | 95 | 95 |
| CD Recovery % | 95 | 95 | 95 | 95 |
| MD Stress Relaxation % | 68 | 50 | 63 | 48 |
| CD Stress Relaxation % | 64 | 50 | 61 | 44 |

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as illustrative embodiments. Equivalent elements or materials may be substituted for those illustrated and described herein, and certain features of the invention may be utilized independently of the use of other features, all as would be apparent to one skilled in the art after having the benefit of this description of the invention.

What is claimed is:

1. A fiber produced from a composition comprising 50 to 100 weight % of one or more non-hydrogenated block copolymers, wherein the one or more, non-hydrogenated block copolymers each have at least two blocks produced from vinyl aromatic monomers and at least one block produced from conjugated alkene monomers, wherein the composition has an order/disorder transition (ODT) onset of less than 280° C., and neither the shear modulus, G', nor loss modulus, G", monotonically increase with temperature in the range from the ODT, or 150° C. in the absence of an ODT, to 280° C., wherein the fiber is in the form of a conjugate fiber which has a sheath/core or tipped multilobal cross section, wherein the fiber has a diameter less than 400 microns, and wherein the fiber is a conjugate fiber, said conjugate fiber comprising the block copolymer and at least one polyolefin component, wherein said polyolefin component at least partially envelops the block copolymer.

2. The fiber of claim 1, wherein the composition comprises up to 50% of a processing additive.

3. The fiber of claim 1, wherein the block copolymer is a triblock having two vinyl aromatic monomer unit blocks and one alkyl-substituted, conjugated alkene monomer unit block, or wherein the block copolymer is a pentablock having three vinyl aromatic monomer unit blocks and two alkyl-substituted conjugated alkene monomer blocks.

4. The fiber of claim 1, wherein the conjugated alkene monomer is isoprene.

5. The fiber of claim 1, wherein the conjugated alkene monomer is of formula $R_2C{=}CR{-}CR{=}CR_2$, wherein the monomer has at least five carbons, and wherein each R, independently in each occurrence, is hydrogen or alkyl of from one to four carbons or any two R may form a ring.

6. A woven or knitted fabric, yarn, filament, strand, or fine net comprising the fiber of claim 1.

7. A nonwoven comprising the fiber of claim 1.

8. The nonwoven of claim 1, wherein the fibers are bonded at a temperature substantially below the normal bonding temperature of the polyolefin component.

9. The fiber of claim 1 where the heated fiber is drawn at a velocity of 300 m/min or greater.

10. A laminate wherein at least one layer comprises the fibers of claim 1.

11. An article comprising fibers of any claim 1.

12. A fiber or nonwoven of claim 1 is produced by a spunbond process.

13. The fiber of claim 1, wherein the fiber can be drawn at a velocity greater than or equal to 300 meters/minute.

14. A fiber produced from a composition comprising 50% to 100% by weight of one or more block copolymers, wherein at least one block copolymer has at least two blocks produced from a vinyl aromatic monomer having up to 20 carbons and from a conjugated alkene monomer of formula:

$$R_2C{=}CR{-}CR{=}CR_2$$

wherein each R, independently in each occurrence, is hydrogen, or alkyl of one to four carbons, or any two R join to form a ring, wherein the conjugated alkene monomer has at least five carbons and no more than 20 carbons, wherein the fiber is in the form of a conjugate fiber which has a sheath/core or tipped multilobal cross section, wherein the fiber has a diameter less than 400 microns, and wherein the fiber is a conjugate fiber, said conjugate fiber comprising the block copolymer and at least one polyolefin component, wherein said polyolefin component at least partially envelops the block copolymer.

15. The fiber of claim 14, wherein the composition comprises up to 50% of a processing additive.

16. The fiber of claim 14, wherein the conjugated alkene monomer is isoprene.

17. The fiber of claim 14, wherein the core comprises a styrene-isoprene-styrene triblock copolymer or a styrene-isoprene-styrene-isoprene-styrene pentablock copolymer.

18. A woven or knitted fabric, yarn, filament, strand, or fine net comprising the fiber of any claim 14.

19. A nonwoven comprising the fiber of claim 14.

20. An article of manufacture comprising a multifilament yarn, woven or knitted fabric or nonwoven web comprising at least one fiber made from a composition comprising 50% to 100% by weight of one or more block copolymers, wherein each block copolymer has at least two blocks produced from a vinyl aromatic monomer having up to 20 carbons and from a conjugated alkene monomer of formula:

$$R_2C{=}CR{-}CR{=}CR_2$$

wherein each R, independently in each occurrence, is hydrogen or alkyl of one to four carbons or any two R form a ring, wherein the conjugated alkene monomer has at least five carbons and no more than 20 carbons, wherein the fiber is in the form of a conjugate fiber which has a sheath/core or tipped multilobal cross section, wherein the fiber has a diameter less than 400 microns, and wherein the fiber is a conjugate fiber, said conjugate fiber comprising the block copolymer and at least one polyolefin component, wherein said polyolefin component at least partially envelops the block copolymer.

21. The article of claim 20, wherein the conjugated alkene monomer is isoprene.

22. A woven or knitted fabric, yarn, filament, strand, or fine net comprising the article of claim 20.

23. A nonwoven comprising the article of claim 20.

* * * * *

UNITED STATES PATENT AND TRADEMARK OFFICE

CERTIFICATE OF CORRECTION

PATENT NO. : 7,309,522 B2
APPLICATION NO. : 10/887467
DATED : December 18, 2007
INVENTOR(S) : Steven P. Webb et al.

It is certified that error appears in the above-identified patent and that said Letters Patent is hereby corrected as shown below:

In claim 1, column 32, line 55, delete "150° C.," and insert --150°C--.

In claim 1, column 32, line 56, delete "280° C.," and insert --280°C--.

Signed and Sealed this

Twenty-ninth Day of April, 2008

JON W. DUDAS
*Director of the United States Patent and Trademark Office*